US005704530A

United States Patent [19]

Scherer

[11] Patent Number: 5,704,530

[45] Date of Patent: Jan. 6, 1998

[54] BACKPACK WITH ADJUSTABLE SHOULDER HARNESS

[75] Inventor: Michael J. Scherer, Boulder, Colo.

[73] Assignee: American Recreation Products, Inc., St. Louis, Mo.

[21] Appl. No.: 613,903

[22] Filed: Mar. 11, 1996

[51] Int. Cl.[6] ..... A45F 3/08

[52] U.S. Cl. ..... 224/632; 224/634

[58] Field of Search ..... 224/185, 197, 224/210, 211, 212, 213, 261, 262, 263, 628, 631, 632, 633, 634

[56] References Cited

U.S. PATENT DOCUMENTS

| | | | |
|---|---|---|---|
| 3,347,429 | 10/1967 | Ruth, Jr. . | |
| 3,581,961 | 6/1971 | Owens . | |
| 3,653,566 | 4/1972 | Owens . | |
| 3,699,986 | 10/1972 | Kirkham . | |
| 3,827,612 | 8/1974 | Mead et aL. . | |
| 3,831,827 | 8/1974 | Olson . | |
| 4,361,259 | 11/1982 | Chanter | 224/211 |
| 4,660,751 | 4/1987 | Von Dewitz | 224/210 |
| 4,676,418 | 6/1987 | Lowe | 24/262 X |
| 5,005,744 | 4/1991 | Gleason . | |
| 5,090,604 | 2/1992 | Hoe . | |
| 5,181,638 | 1/1993 | McHale . | |
| 5,228,609 | 7/1993 | Gregory . | |

FOREIGN PATENT DOCUMENTS

| | | | |
|---|---|---|---|
| 297188 | 1/1989 | European Pat. Off. | 224/213 |
| 3634621 | 4/1988 | Germany | 224/213 |

OTHER PUBLICATIONS

Adventure 16 Hiphugger & Contour Frame Packs, Advertisement in Backpacker magazine, issue #4, Winter 1973, p. 77.

Alpenlite®, Advertisement in Backpacker magazine, issue #4, Winter 1973, p. 86.

Gregory Mountain Products, Temecula, CA, Gregory Catalog, 1993 (admitted prior art).

Osprey, Dolores, CO, Osprey 1993 Catalog, 1993 (admitted prior art).

Dana Design, Bozeman, MT, Dana Design 1993 Catalog, 1993 (admitted prior art).

*Primary Examiner*—Renee S. Luebke

*Attorney, Agent, or Firm*—Senniger, Powers, Leavitt & Roedel

[57] ABSTRACT

A backpack comprising a bag, a frame for supporting the bag, a slider carrying a shoulder harness slidable up and down on the frame to adjust the position of the shoulder harness to suit a person wearing the backpack, and strips of VELCRO material secured respectively to the slider and the bag for releasably fastening the slider in adjusted position heightwise of the frame.

19 Claims, 19 Drawing Sheets

53
53
53
31
13
11
75
77
61
φ

53
31
53
53
53
13
11
75
77
61
φ

53
31
53
53
13
11
75
77
61
φ

35
121
129
127
123
B
120
49
141
143

CP
233
258
270
269
255a
257L
257r
258
255b
257
253a
255
251a
211
253
251
215
223
304a
303
303a
293
304a
304
303b
304
309a
291
291
217
321
217
339
13
13
213
345
349
349
345
341
341
14
14
213
219
303
217
275
281
281

261
270
269
262
233
257r
257l
255
259
349
253a
349
251
253
251c
223
213
335
335
253c
289
299a
301a
295
297
273
295
291
293
291
293
365
271
365
287
253b
284
285
251b
349
301
299
283
349
350
350
279
277
275
219
281
281

CP
CP
303
305
305
307
309
311
313
317
319
321
323
325
327
329
331
333
333
333
335
335
345
345
349
349
350
350
353
353
304
251
253
221
225
227
231
239
239
241
241
247
247
213

BACKPACK WITH ADJUSTABLE SHOULDER HARNESS

BRIEF SUMMARY OF THE INVENTION

This invention relates generally to backpacks of the type generally comprising a bag mounted on a frame, a shoulder harness for supporting the bag and frame from the user's shoulders and a belt for encircling the user's waist.

The invention is especially concerned with backpacks of the aforesaid type constructed for transferring a portion of the load carried by the backpack (and the weight of the backpack itself) from the user's shoulders to the user's waist. Reference may be made to U.S. Pat. No. 5,090,604 to Howe for an example of a backpack which is so constructed. The invention is also concerned with backpacks which are capable of being adjusted to fit the wearer's body shape. One such family of backpacks, marketed by vauDe of Obereisenbach, Germany, as the "Tergoflex", "Tergonomic-SH" or "Tergonomic-S" System, has an adjustable shoulder harness which requires a tool (e.g., a screwdriver) to adjust the shoulder harness.

Among the several objects of this invention may be noted the provision of an improved backpack adapted effectively to transfer weight from the wearer's shoulders to the user's waist; the provision of such a backpack having a shoulder harness which is capable of being adjusted to suit the user's body shape; the provision of such a backpack wherein the shoulder harness is adjustable without the aid of tools; the provision of such a backpack which form-fits to the wearer; the provision of such a backpack which is constructed for easy replacement of worn components of the backpack; and the provision of such a backpack which is durable, lightweight and comfortable to wear.

Two embodiments of the invention are herein disclosed, the first being that which was disclosed in the applicants application Ser. No. 08/250,467 and the second, which is presently the preferred embodiment, being that disclosed in the figures of the drawing added thereto and that part of the specification relating to the added figures.

In the principal aspect of the invention, common to the two embodiments, the backpack comprises a bag having front and back walls, a support structure for the bag comprising a frame extending heightwise of the bag on the outside of the front wall of the bag adjacent opposite sides of the bag. A slider slidably connected to the frame for sliding up and down on the frame in front of the front wall of the bag has opposite sides adjacent respective sides of the frame. A shoulder harness is attached to the slider for releasably securing the backpack to the shoulders of a person wearing the backpack, the slider and shoulder harness attached thereto being slidable up and down on the frame to adjust the position of the shoulder harness to suit a person wearing the backpack. Sliding connections between the slider and the frame permit up-and-down movement of the slider relative to the frame. Means for releasably fastening the slider in adjusted position relative to the frame comprises hook and loop fastener members, i.e. first VELCRO fastening members e.g. VELCRO hook members secured to the slider adjacent opposite sides thereof, fabric members secured to the support structure and generally fixed against up and down movement relative to the support structure, and second VELCRO fastening members e.g. VELCRO loop members secured to said fabric members in position for being releasably engaged in interlocking manner by said first VELCRO fastening members in various adjusted positions of the slider heightwise with respect to the frame.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
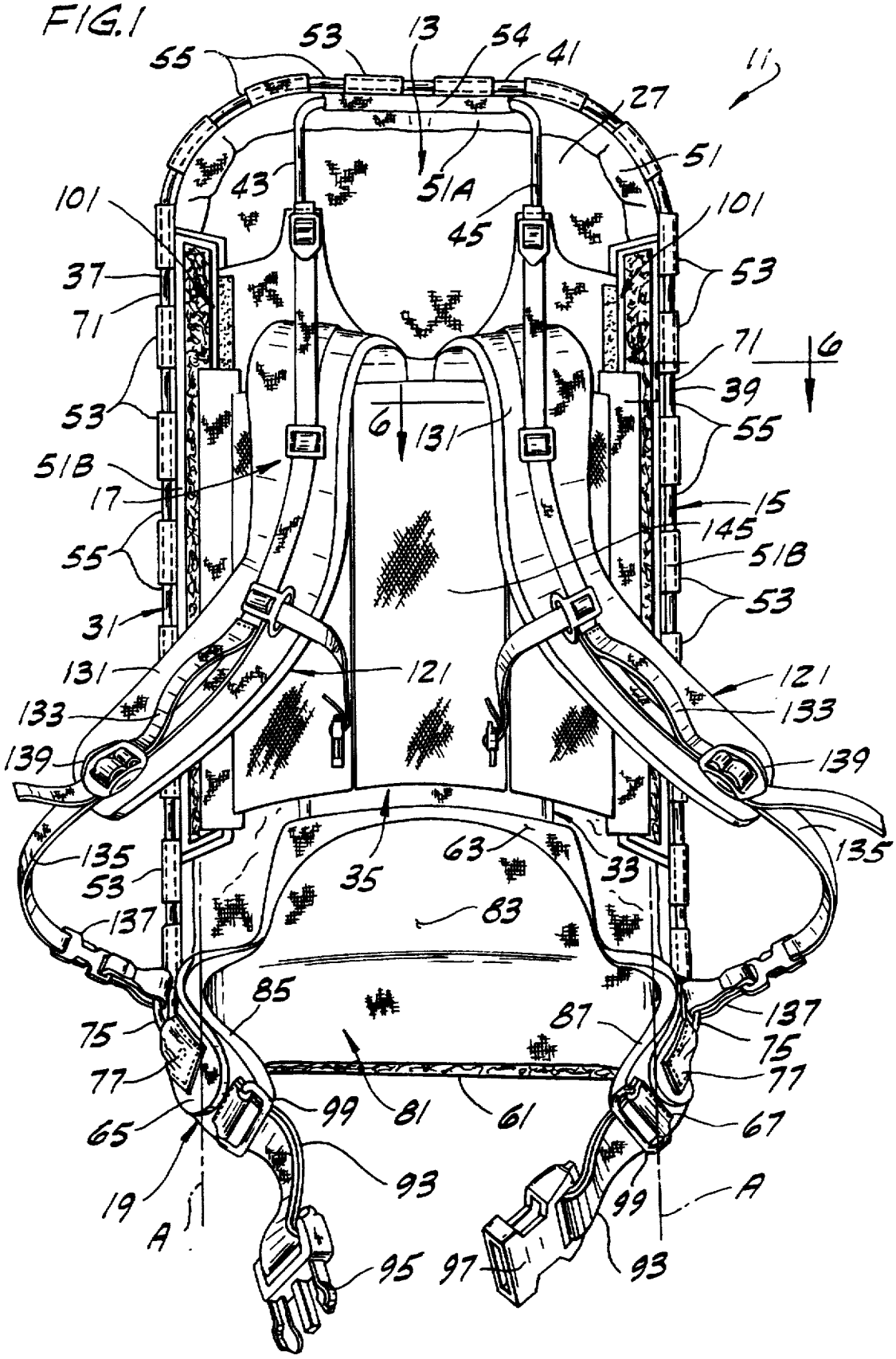
FIG. 1 is a front elevation view of a first embodiment of a backpack of this invention.

Referring first to FIGS. 1–9 of the drawings, a first embodiment of a backpack of this invention is indicated in its entirety by the reference numeral 11. As shown, the backpack 11 comprises a bag generally indicated at 13 (FIGS. 4 and 8), a support structure generally indicated at 15 for supporting the bag, a shoulder harness, generally indicated at 17, for releasably securing the backpack around the shoulders of a person wearing the backpack, and a belt assembly generally indicated at 19 for releasably securing the backpack around the person's waist. The backpack 11 is constructed from relatively lightweight materials (e.g., nylon, plastic and aluminum) so that it is easy to carry. The backpack 11 is also designed to form-fit to the person wearing it and to distribute a load carried by the bag 13 of the backpack from the person's shoulders to the person's sides at the waist.

The bag 13 is constructed of flexible sheet material (e.g., nylon) and is releasably attached to and supported by the support structure 15 which will be discussed in greater detail below. The bag 13 is of conventional construction and includes a compartment 23 (FIG. 4) accessible through an opening which may be closed by a zipper or a draw string (not shown). The compartment 23 is of sufficient size to store items used when backpacking (e.g., cooking equipment, sleeping bags, clothes, etc.) Smaller compartments 25 may also be provided on the exterior of the bag 13 for storing smaller items. It is to be understood that the bag 13 may be constructed in any number of ways and still fall within the scope of the present invention.

Figure 2:
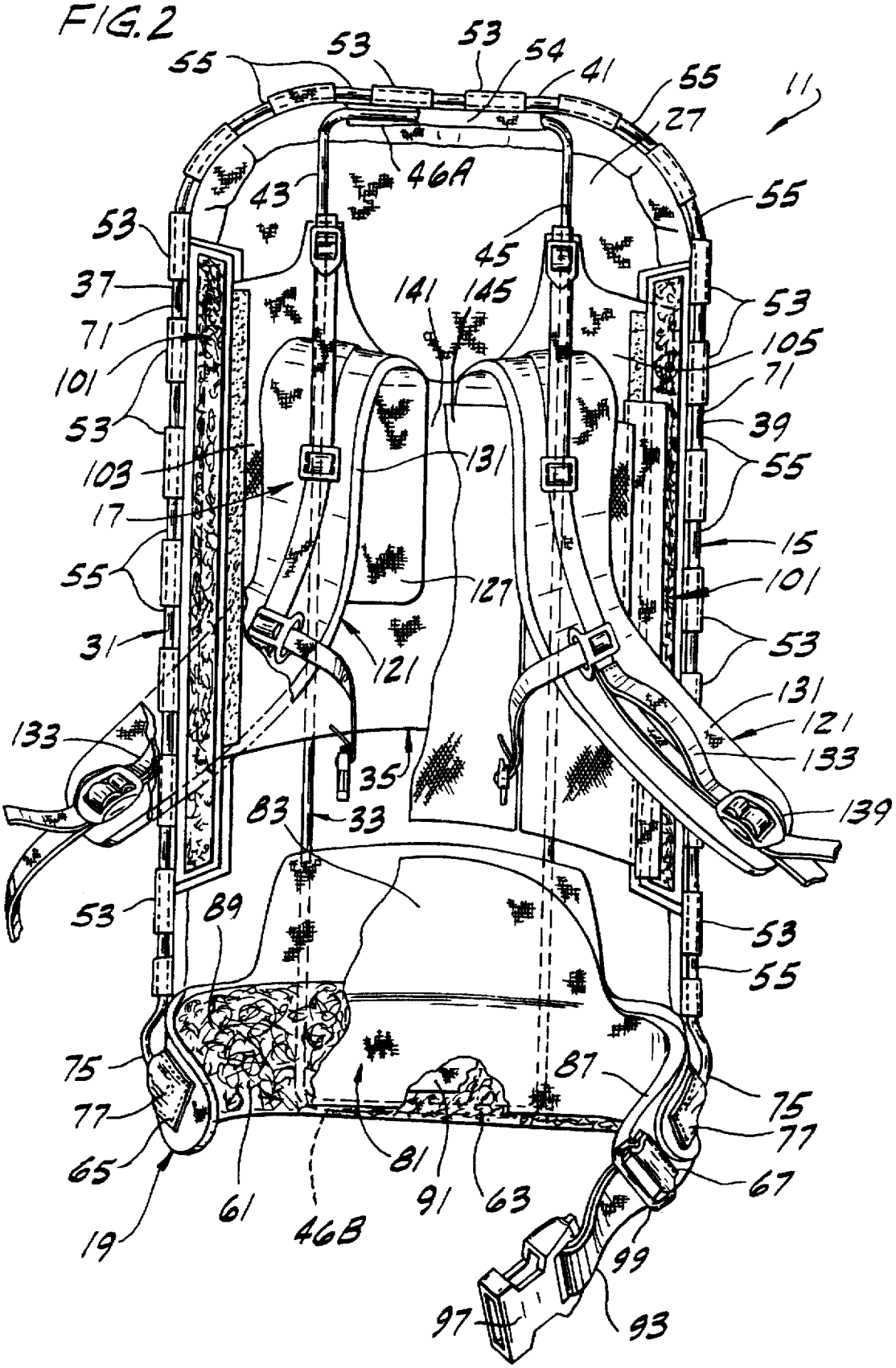
FIG. 2 is a front elevational view of the FIG. 1 backpack with portions removed to reveal details of the backpack.
Figure 4:
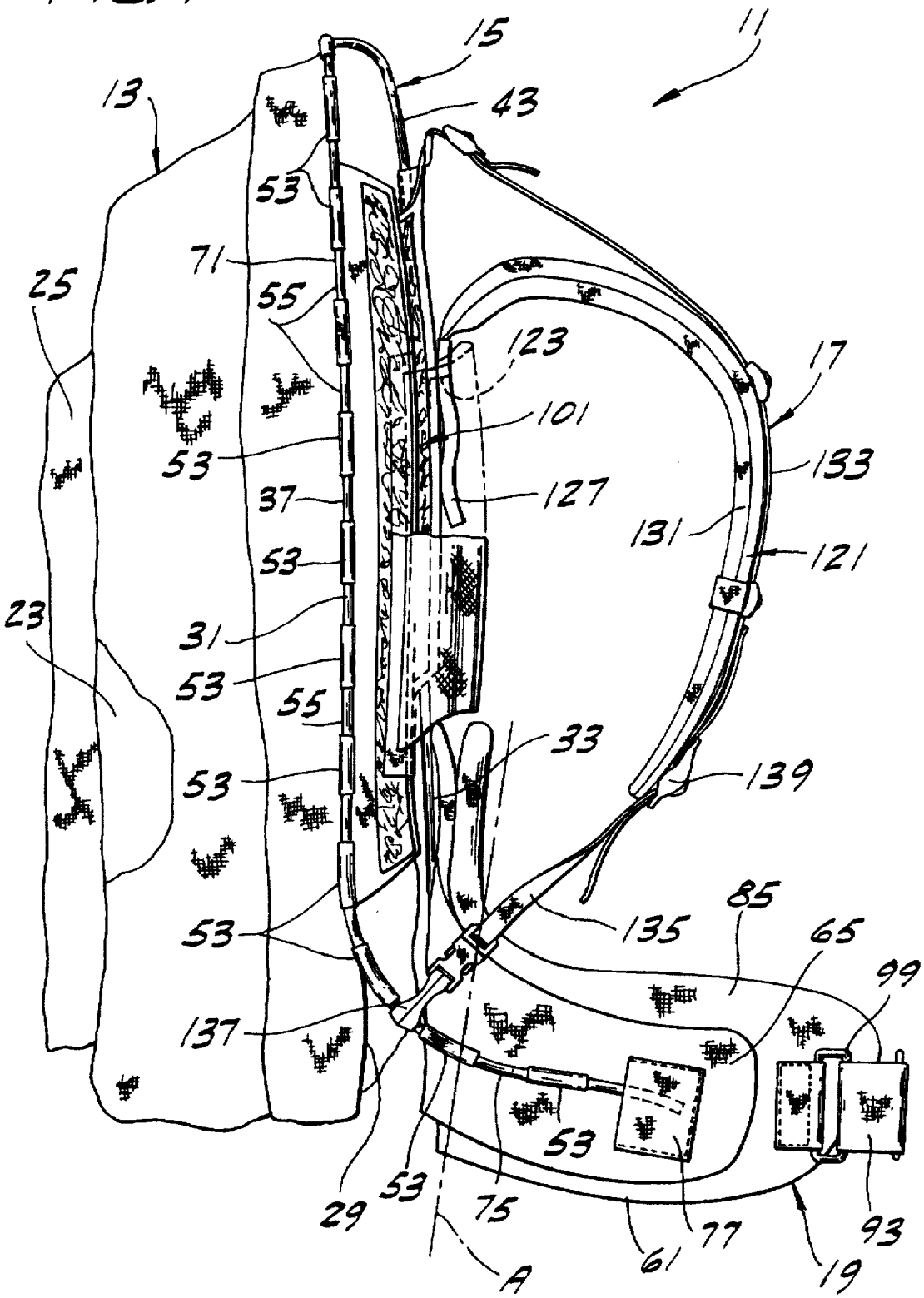
FIG. 4 is a side elevational view of the FIG. 1 backpack with portions removed.

As best illustrated in FIGS. 2 and 4, the support structure 15 comprises an outer frame generally designated 31, an inner frame generally designated 33, and a slider generally designated 35. The outer frame 31 is generally of inverted U-shape, having a horizontal top frame member 41 adjacent the top of the backpack, and a pair of laterally spaced side frame members 37, 39 extending down from the top frame member at opposite sides of the backpack to adjacent the bottom of the backpack. The outer frame is preferably integrally formed from a single piece of bent wire formed from a suitable lightweight material, such as solid metal rod fabricated from spring steel (e.g., ASTM A313 stainless steel, ASTM A228 high carbon steel) having a diameter of approximately 0.145 inch.

The inner frame 33 is of rectangular shape, having a pair of generally parallel vertical wire frame members 43, 45 connected at their ends by horizonal cross wire frame members 46A, 46B (FIG. 2) which are integral with the wire frame members 43, 45. The inner frame is positioned between the side frame members 37, 39 of the outer frame 31 and extends in up-and-down direction relative to the backpack 11 as it is worn. The inner frame 33 is preferably fabricated from the same lightweight material as the outer frame 31.

Figure 3:
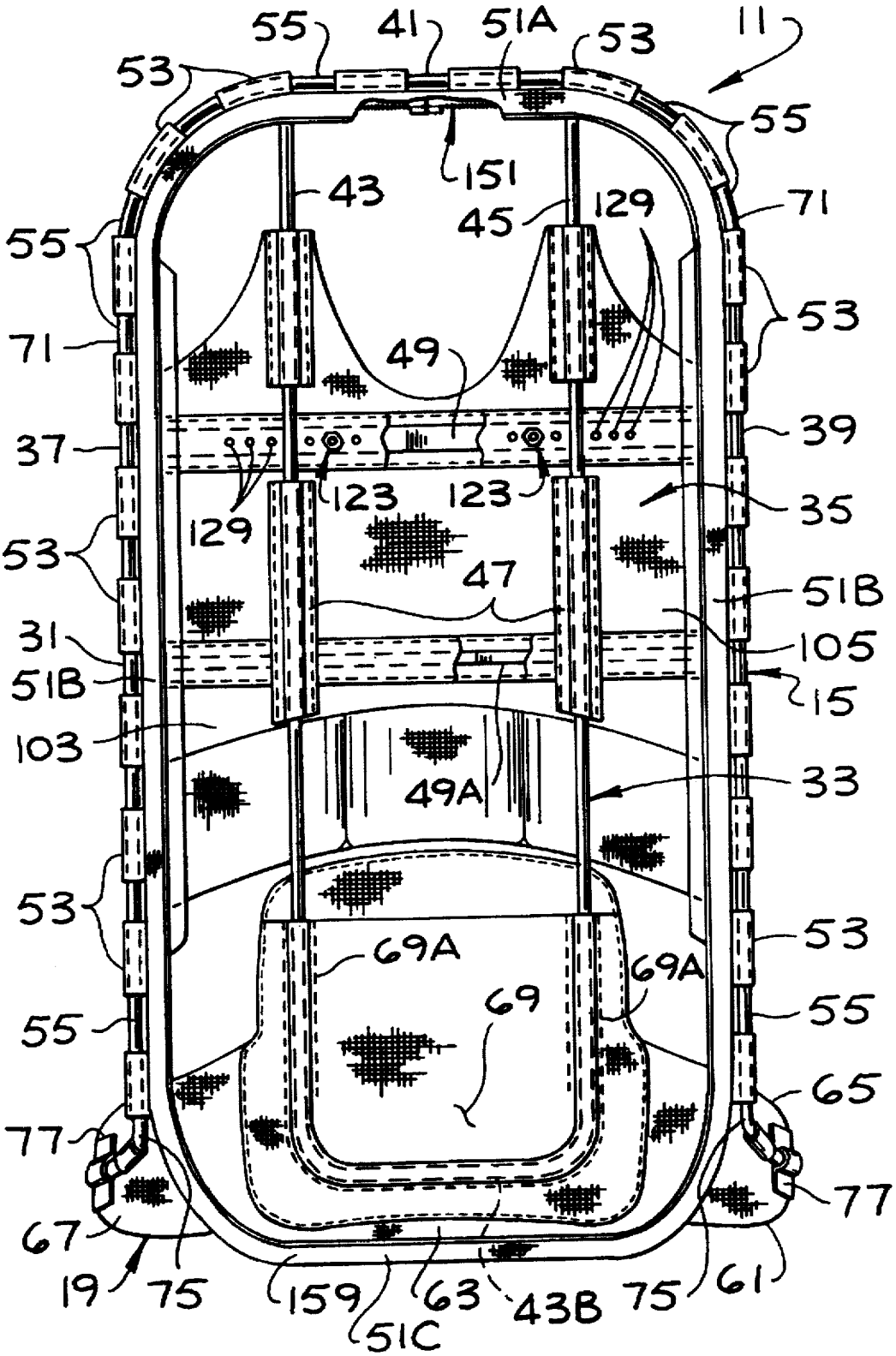
FIG. 3 is a rear elevational view of the FIG. 1 backpack with portions removed.
Figure 6:
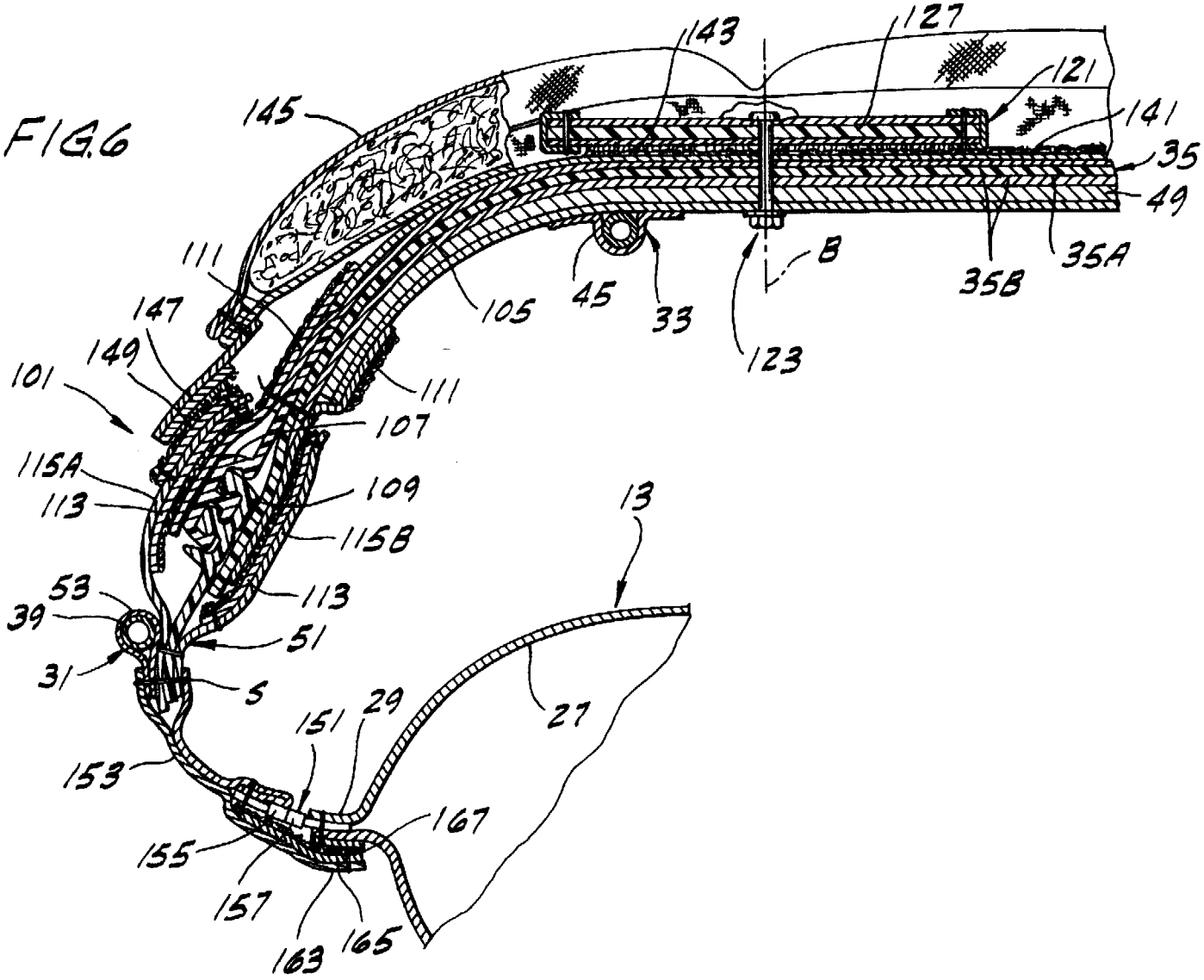
FIG. 6 is an enlarged section taken along line 6—6 of FIG. 1.

The slider 35 is made from a substantially rigid, relatively thin piece 35A of material (e.g., plastic as shown in FIG. 6) enclosed within a cover 35B of suitable sheet material (e.g., nylon as shown in FIG. 6). As illustrated in FIG. 3, a pair of sleeves 47 are stitched to the cover 35B and receive respective wire frame members 43, 45 of the inner frame 33 therethrough to mount the slider 35 on the wire frame members for sliding up-and-down movement of the slider on the wire frame members. The slider 35 further includes a bar 49 of flat stock metal material (e.g., aluminum) and a rigid rod 49A (also made from aluminum) extending across the rigid piece 35A for reinforcing it. The bar 49 and rod 49A are held in place by fabric material stitched to the cover 35B. As will be discussed in more detail hereinafter, the shoulder harness 17 is mounted on the slider 35 for up-and-down movement with the slider. When worn, the slider 35 is adapted to lie generally flat relative to the back of the person wearing the backpack 11.

The support structure 15 also includes carrier strip means comprising a carrier strip 51 of flexible material (e.g., nylon) for interconnecting the outer frame 31, the inner frame 33 and the slider 35. The carrier strip 51 is annular (e.g. generally rectangular) in shape, having a top part 51A extending along the top frame member 41 of the outer frame 31 and the top cross wire frame member 46A of the inner frame 31, opposite side parts 51B extending along respective side frame members 37, 39 of the outer frame and a bottom part 51C connecting the side parts 51B at their lower ends (see FIG. 3). The top and side parts 51A, 51B of the carrier strip 51 are attached to the outer frame 31 by loops 53 spaced at intervals along the top and side frame members. The loops 53 are separated by exposed portions 55 of the top and side frame members. The top part 51A of the carrier strip 51 also comprises a sleeve 54 (FIGS. 1 and 2) for securing the top cross wire frame member 46A of the inner frame 33 to the top frame member 41 of the outer frame 31. The remainder of the carrier strip 51 will be discussed in greater detail below.

The belt assembly 19 releasably secures the backpack 11 around a person's torso. The belt assembly 19 includes a belt 61 (FIGS. 1 and 2) having a back portion 63 attached to the inner frame 33 of the support structure 15, a first (left as viewed in the drawings) side portion 65 extending forwardly at the left side of the back portion, and a second (right) side portion 67 extending forwardly at the right side of the back portion. The back portion 63 comprises a rigid (e.g., plastic) plate covered by flexible sheet material. As illustrated in FIG. 3, a sheet of material 69 sewn onto the rear surface of the back portion 63 of the belt forms a pocket which receives the lower end of the inner frame 33, thereby securing the back portion of the belt in fixed position relative to the inner frame. Stitching 69A is provided adjacent the bottom cross wire frame member 46B and the lower portions of the wire frame members 43, 45 of the inner frame 33 to secure inner frame to the belt 61.

The side portions 65, 67 of the belt 61 are relatively stiff (e.g., made from pieces of plastic separate from or integral with the back plate and encased in a suitable covering material) for more efficiently distributing the load of the backpack 11 about the person's sides at the waist. As shown in FIG. 1, the side portions 65, 67 of the belt 61 pivot with respect to the back portion 63 about generally vertical axes A. Thus, each side portion 65 and 67 is capable of pivoting to a position where it is held tightly against the waist of the person wearing the backpack 11.

Referring to FIG. 4, each side frame member 37, 39 of the outer frame 31 has an upper (generally vertical) portion 71 extending down from the top frame member 41 and a lower portion, integral with the upper portion, curving forwardly to form a resiliently flexible wire arm 75 attached to a respective left or right side portion 65, 67 of the belt 61. The wire arms 75 and respective side portions 65 or 67 of the belt 61 are constructed to assume positions adjacent opposite sides of the waist when the backpack 11 is worn with the belt 61 around the waist. This construction serves to transfer a portion of the load carried by the back-pack 11 from the person's shoulders and back to the person's sides at the waist.

As mentioned above, the outer frame 31 (including the wire arms 75) is preferably made from spring steel rod having a diameter of approximately 0.145 inch. The wire arms 75 are sufficiently rigid to transfer a portion of the load carried by the support structure 15 of the backpack 11 from the person's shoulders to the person's sides at the waist. However, the arms 75 are sufficiently resiliently flexible to flex up and down substantially independently of the upper portions 71 of the side frame members 37, 39 in rhythm to the up and down rolling movement of the person's waist as the person walks. Thus, the wire arms 75 maintain the transfer of a portion of the load to the person's waist while minimizing any wobble of the load from side-to-side on the back of the person because of the flexibility of the wire arms. It is to be understood that materials other than spring steel may be used, such as plastic, other metal materials (e.g., aluminum, titanium), carbon fiber materials and composite materials. Tubing, instead of solid rods, may also be used.

Figure 4C:
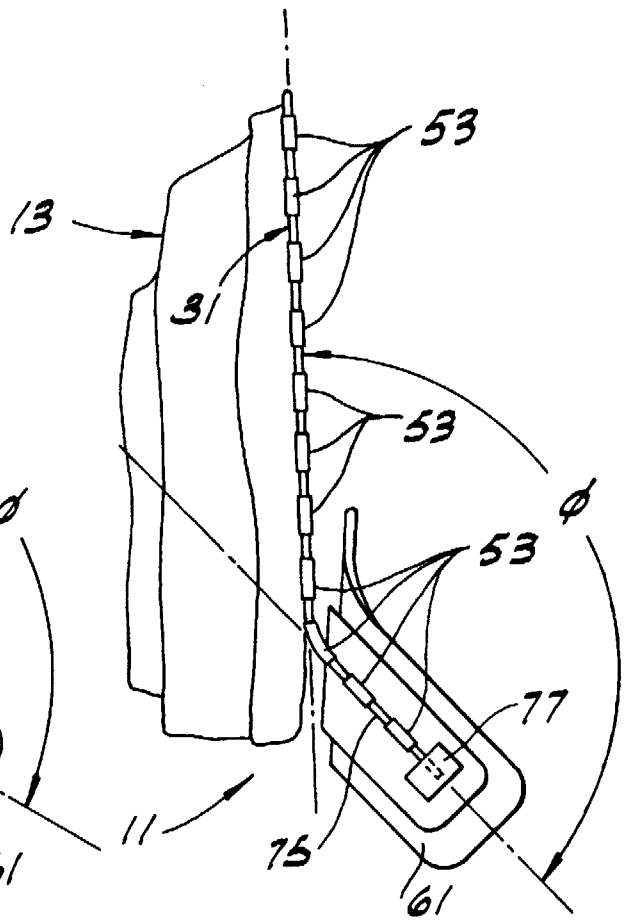
FIGS. 4A–4C are elevation views illustrating a side frame member of the FIG. 1 backpack bent at varying angles to vary the amount of a load transferred from the wearer's shoulders to the wearers waist.
Figure 4B:
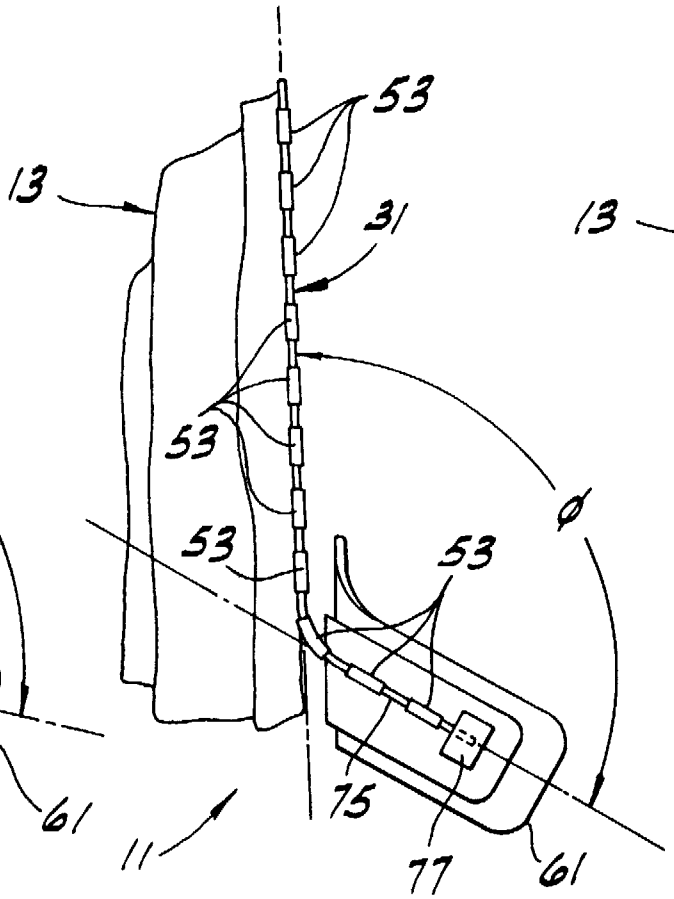
Figure 4A:
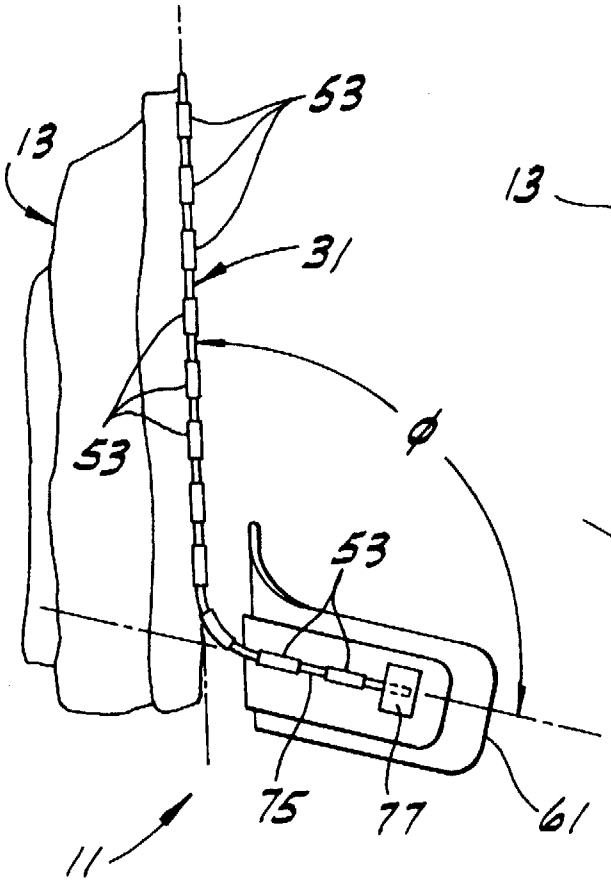

The amount of load transferred to the person's waist will depend of the stiffness on the wire arms 75 and on the angle $\phi$ (FIGS. 4A–4C) formed between the wire arms 75 and the upper portions 71 of the side frame members 37, 39. FIGS. 4A–4C illustrate several bend configurations (as illustrated, the wire arms 75 are in an unflexed condition, i.e., the backpack is not being worn). The bend angle $\phi$ in FIG. 4A is relatively small (e.g., 105°) for transferring a relatively small portion of the load to the person's sides at the waist. FIG. 4B shows a relatively moderate bend angle $\phi$ (e.g., 130°) for transferring a moderate portion of the load. FIG. 4C illustrates a relatively large bend angle $\phi$ (e.g., 150°) for transferring a relatively large portion of the load. It will be noted in this regard that while the wire arms 75 are resilient within a limited range of movement, they are also bendable beyond the point of elasticity to adjust the angle $\phi$ to suit the circumstances. Bend angle $\phi$ is preferably approximately 90° for each bend configuration (4A–4C) when the backpack is comfortably loaded and in place on the wearer.

As noted, the amount of load transferred to the waist can be increased by increasing the bend angle $\phi$ between the wire arms 75 and their respective side frame members 37, 39. However, increasing this angle also reduces the flexibility of the arms 75 (i.e., the angular range of movement through which the arms swing as the wearer of the pack is walking), which can result in more side-to-side wobble of the load carried by the backpack (although still less than prior designs). This is because the arms 75, as they become more rigid, also become less effective for absorbing the up-and-down movement of the hips and isolating such movement from the load.

Each wire arm 75 is releasably attached to a respective side portion 65, 67 of the belt 61 by means of a pocket 77 (FIG. 4) sewn to the outer surface of the side portion. The pocket 77 receives the free end of the wire arm 75 thereby attaching the wire arm to the belt 61. The wire arms 75 may be bent inwardly toward one another to provide a snugger fit of the belt 61 around the person's waist.

A flexible waist pad, generally indicated at 81 in FIGS. 1 and 2, is attached to the belt 61 in a position where the pad is disposed between the belt and the person's waist. The waist pad 81 is constructed of one or more pieces of foam material encased by opposing panels of sheet material secured (e.g., stitched) together at their peripheries. The waist pad 81 cushions the back and sides of a person wearing the backpack from the relatively rigid back and side portions 63, 65 and 67 of the belt 61. As illustrated in FIGS. 1 and 2, the waist pad 81 has a back section 83 corresponding to the back portion 63 of the belt 61 and two side sections 85, 87 extending from opposite sides of the back section 83 corresponding to respective side portions 65, 67 of the belt.

The waist pad 81 is preferably releasably attachable to the belt 61 so that it may be adjusted relative to the belt. To this end, the back and side portions 63, 65 and 67 of the belt 61 have a first VELCRO fastening strip 89 (FIG. 2) affixed to the inside surface of the belt. This fastening strip 89 may be attached to the belt 61 by adhesive. The back and side sections 83, 85 and 87 of the waist pad 81 have a second VELCRO fastening strip 91 (FIG. 2) affixed to the outer surface of the waist pad. This fastening strip 91 is releasably interengageable with the fastening strip 89 on the belt 61 for removably attaching the waist pad 81 to the belt 61. It is envisioned that fasteners other than a VELCRO fastener could be used. However, VELCRO is preferable since it enables the person wearing the backpack 11 to easily adjust the waist pad 81 relative to the belt 61 to a position suitable to the person wearing the backpack. The waist pad 81 may also be removed from the backpack 11 and combined with a small pack not having a frame (e.g., a fanny pack) for use during day hikes. The waist pad is also preferably secured to the ends of the belt 61 by releasable straps (not shown).

As illustrated in FIGS. 1 and 4, a pair of flexible straps (e.g., nylon straps), each indicated 93, are sewn to the outer surfaces of the side sections 85, 87 of the waist pad 81. These straps 93 secure the waist pad 81 and belt 61 around the person's waist. It is to be understood that these straps 93 may be attached directly to the belt 61 instead of to the waist pad 81. The free ends of the straps 93 are releasably connected to one another by a two-part connector of the type illustrated in FIG. 1. The connector includes a male connecting device 95 releasably attached to one of the straps 93 (e.g., the left-hand strap as viewed in FIG. 1) and a female connecting device 97 releasably attached to the other strap (e.g., the right-hand strap as viewed in FIG. 1). These connecting devices 95, 97 are made from hard synthetic material, each having two slots (not shown) formed therein for receiving and securing the respective free ends of the straps 93 in conventional fashion. The connecting devices 95, 97 are designed to maintain the straps 93 in their shortened condition when tightening the belt 61 about the person's waist.

Two rigid loops 99, one for each strap 93, are provided for cinching the belt to tighten it about the person's waist. These rigid loops are described in greater detail in U.S. Pat. No. 5,465,886. Briefly, these loops 99 are affixed to the waist pad 81 adjacent to where the straps 93 are attached to respective side sections 85, 87 of the waist pad. The rigid loops 99 may be constructed of hard synthetic material, for example, or from metal, such as stainless steel.

As noted above, the shoulder harness 17 is attached to the slider 35 which is slidable up-and-down on the inner frame 33. This enables adjustment of the vertical position of the shoulder harness 17 to suit the body shape of the person wearing the backpack 11. By measuring the length of the person's back with a scale, for example, the slider 35 carrying the shoulder harness may be vertically adjusted to the appropriate position so that the backpack 11 is properly fitted to the person's body shape.

Figure 5:
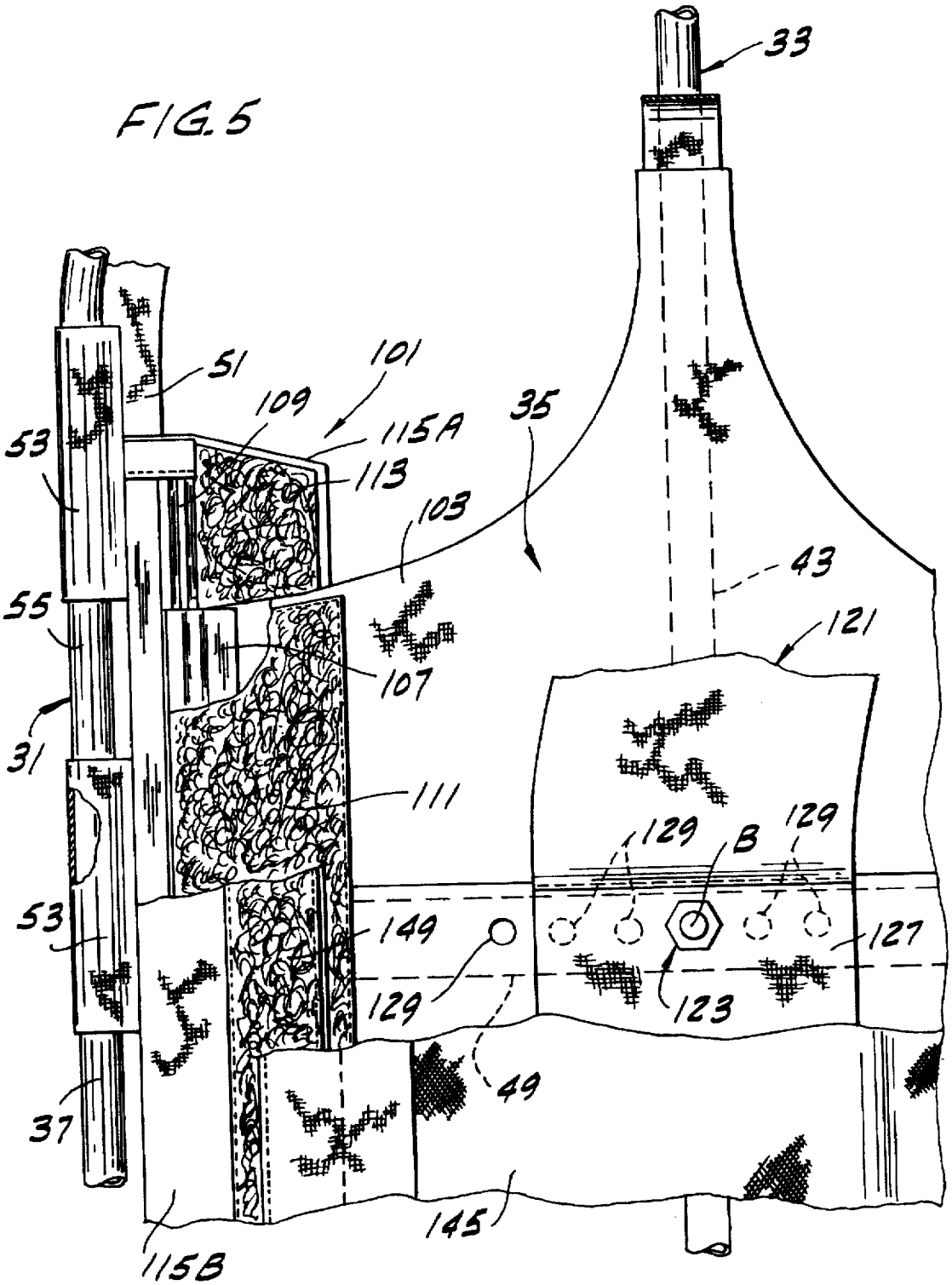
FIG. 5 is an enlarged view of a section of the FIG. 1 backpack showing sliding connections and fasteners with portions removed.

Turning now to FIGS. 5 and 6, sliding connections, generally indicated at 101, between opposite sides 103, 105 of the slider 35 and the respective side frame members 37, 39 of the outer frame 31 permit up-and-down movement of the slider 35 relative to the outer frame 31 while prohibiting substantial side-to-side movement of the slider relative to the outer frame. As noted above, the sleeves 47 on the slider 35 receive the wire frame members 43, 45 of the inner frame 33 for allowing the up-and-down sliding movement of the slider on the wire frame members. Each sliding connection 101 comprises a tongue and groove member 107 extending along a respective side of the slider and a mating tongue and groove member 109 extending along a respective side frame member 37, 39. The tongue and groove members 107, 109 are made from flexible material (e.g., plastic) and, as shown in FIG. 6, are releasably connected to one another by means of releasably interfitting tongues and grooves. Tongue and groove member 107 is attached to the slider 35 by stitching S (FIG. 6) and tongue and groove member 109 is attached to the carrier strip 51 by stitching S (FIG. 6). As mentioned above, the carrier strip 51 is secured by loops 53 to the outer frame 31.

The slider is locked in a selected position of adjustment relative to the outer frame 31 by means of fasteners. FIG. 5 illustrates an arrangement for locking the left side 103 of the slider 35 in a fixed position relative to the left side frame member 37 of the outer frame 31. The right side 105 of the slider 35 is locked to the right side frame member 39 of the outer frame 31 in identical fashion and is illustrated in FIG. 6. Specifically, the fastener arrangement shown in FIGS. 5 and 6 comprises a first pair of VELCRO fastening strips 111 attached (as by stitching S) to the front and rear surfaces of the slider 35 along a respective side (103 or 105) of the slider. These fastening strips 111 are releasably interengageable with a second pair of VELCRO fastening strips 113 attached to flexible front and rear flaps 115A, 115B of the carrier strip. Each VELCRO fastening strip of the second pair 113 is stitched to its respective flap 115A, 115B. As shown, the fastening strip 113 on the front flap 115A is adapted to mate with a corresponding fastening strip 111 on the front surface of the slider 35. Similarly, the fastening strip 113 on the rear flap 115B is adapted to mate with a corresponding fastening strip 111 on the rear surface of the slider 35. The mating tongue and groove members 107, 109 are disposed between the front and rear flaps 115A, 115B when the first and second pair of fastening strips 111, 113 are interengaged with one another. The front and rear flaps 115A, 115B help to hold the tongue and groove members 107, 109 together.

Thus, it will be observed that the shoulder harness 17 is capable of being vertically adjusted by releasing the first and second pair of fastening strips 111, 113, at each side 103, 105 of the slider 35, and sliding the slider 35 relative to the inner frame 33 to a selected position of adjustment. The first and second pairs of fastening strips 111, 113 are then interengaged once again thereby to lock the slider 35 in position. It will also be observed that the sliding connections 101 limit lateral movement of the slider with respect to the outer frame 31, thereby forming a substantially rigid unit.

The shoulder harness 17 comprises a pair of laterally spaced shoulder straps, each generally designated 121 (FIGS. 1, 2 and 4). Each shoulder strap 121 has a pivot connection, generally indicated at 123, with the slider 35 for allowing pivotal movement of the strap 121 about an axis B extending through the connection and in front-to-back direction with respect to the person wearing the backpack (see FIGS. 5 and 6). More specifically, each shoulder strap 121 comprises a flat, stiff end portion 127 fabricated, for example, from a piece of plastic enveloped by sheet material (e.g., nylon). In the embodiment illustrated in FIGS. 5 and 6, the end portion 127 of the strap 121 is pivotally connected to the bar 49 of the slider 35 through one of a series of openings 129 formed in the bar 49 at horizontally spaced intervals. In the embodiment shown, the pivot connection 123 comprises a nut and bolt fastener in a selected opening 129. The openings 129 are provided so that the shoulder straps 121 can be adjusted laterally toward and away from one another to vary the lateral spacing between them. Each shoulder strap 121 is attached to the slider 35 by inserting the pivot member (i.e., the bolt shown in FIG. 6) through a selected opening 129. Other connectors may be used instead of the nut and bolt fasteners, such as quarter-turn screws engageable with recesses formed in the bar 49 of the slider (not shown). An advantage of using quarter-turn screws is that no tools are needed to make the adjustment.

Each shoulder strap 121 has a padded portion 131 extending from an upper edge of the stiff end portion 127 of the strap. The padded portion 131 is stitched to the end portion 127 and extends downwardly in the manner illustrated in FIGS. 1 and 4. Each strap 121 also includes a flexible top leash 133 and a flexible bottom leash 135. The top leashes 133 of the shoulder straps 121 are attached at their upper ends to upper portions of the slider 35 and the bottom leashes 135 are attached at their lower ends by clips 137 to the side frame members 37, 39 of the outer frame 31 near the bottom of the backpack 11. The top and bottom leashes 133, 135 of each shoulder strap 121 are releasably connected in a conventional manner by a buckle 139 which is fixedly attached to the top leash 133 and receives the upper free end of the bottom leash 135. The upper free ends of the bottom leashes 135 are pulled downwardly to tighten the shoulder straps about the person's shoulders.

Figures 7A, 7B, 7C:
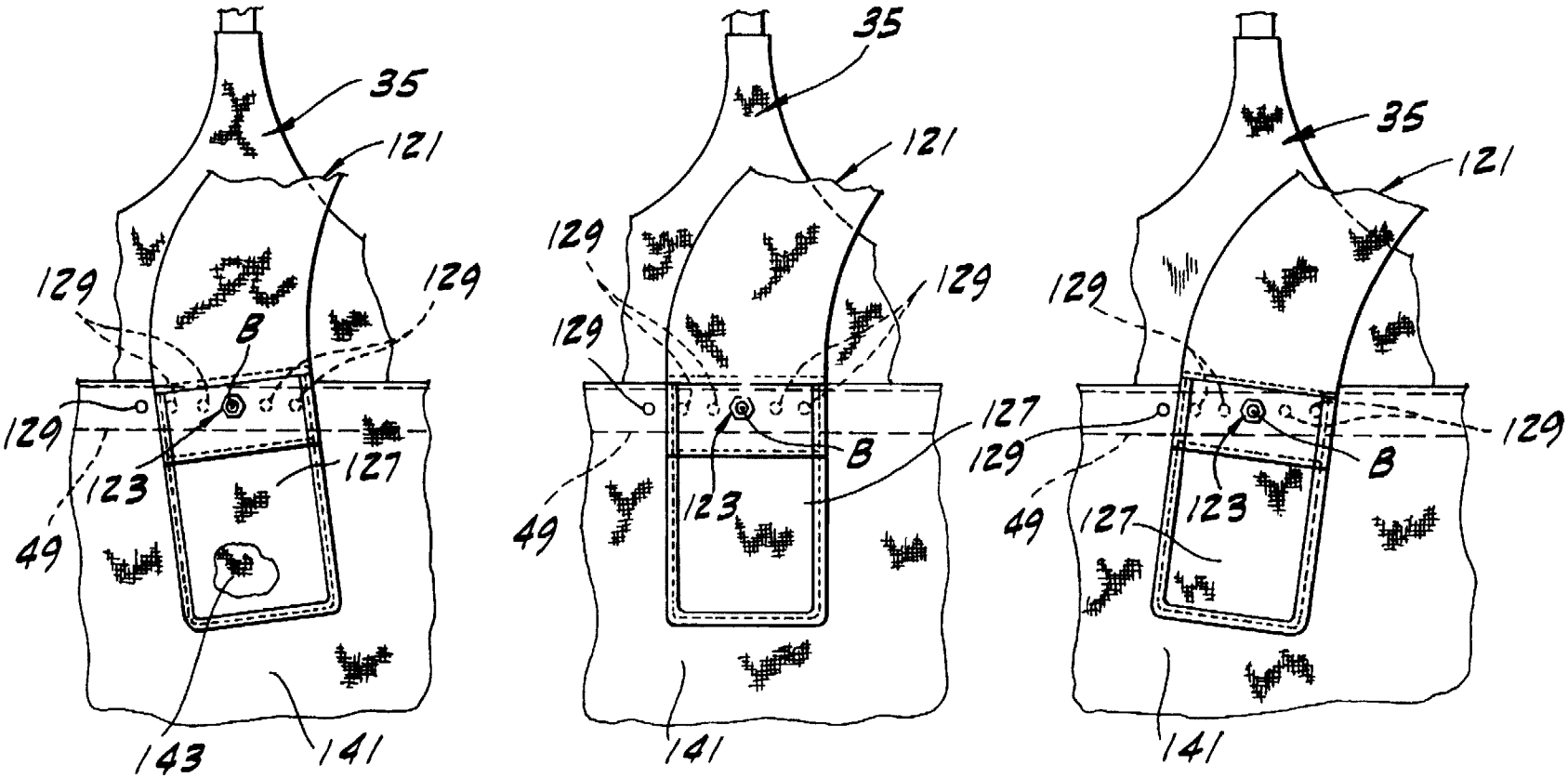
FIGS. 7A–7C are elevation views illustrating a shoulder strap of the FIG. 1 backpack locked in varying selected angular positions of adjustment.

As mentioned above, each shoulder strap 121 is pivotally connected to the slider 35 by pivot connection 123 to allow pivotal movement of the strap about axis B. The pivot connection 123 enables the angular position of the strap to be adjusted to a position suitable for the person wearing the backpack thereby making the shoulder harness more comfortable to wear. Referring to FIGS. 7A–7C, each pivot connection 123 is capable of pivoting in either direction relative to a vertical axis (not shown). The shoulder strap may be locked in any selected position of angular adjustment (see FIGS. 7A–7C for three illustrative positions) by a locking device comprising two patches 141, 143 of VELCRO material, the first (141) of which is on the slider and the second (143) of which is on the stiff end portion 127 of each shoulder strap 121. More specifically, the first patch 141 is affixed (as by stitching) to the side of the slider 35 adjacent the back of the person wearing the backpack 11, and the second patch 143 is affixed (as by stitching) to the side of the stiff portion 127 of the strap 121 facing the slider 35. It will be observed that the angular position of each strap 121 may easily be adjusted by releasing (peeling away) the stiff end portion 127 from the slider 35 and rotating the end portion to a selected position. The end portion 127 may then be pressed against the slider 35 (thereby interengaging the first and second patches of VELCRO material 141, 143) to lock the shoulder strap 121 in the selected angular position.

As illustrated in FIG. 1, a cushion 145 is mounted on the surface of the slider 35 facing the person's back for protecting the person's back. The cushion 145 is made from foam material encased by nylon sheet material (FIG. 6), and strips 147 of VELCRO material are sewn along opposite sides of the cushion. These strips 147 are engageable with mating strips 149 of VELCRO material attached to the back side of the rear flaps 115B of the carrier strip 51, as illustrated in FIGS. 5 and 6. The cushion 145 is releasably secured to the slider 35 by pressing the VELCRO strips 147 on the cushion against the VELCRO strips 149 on the slider 35, and is removed by peeling the cushion 145 away from the slider.

The bag 13 includes a wall 27 having a peripheral edge margin 29 (FIGS. 6 and 8) which is generally adjacent outer frame 31. The bag 13 is releasably attached to the carrier strip 51 of the support structure 15 by fastener means, which is shown to be a strong, durable, heavy-duty zipper generally designated 151, such as a no. 8 Delrin® zipper manufactured by YKK U.S.A. Inc. of St. Louis, Mo. As illustrated in FIG. 6, the zipper 151 comprises a first row of teeth 155 carried by a double ply strip of material 153 attached to the carrier strip 51 and a second row of teeth 157 sewn to the peripheral edge margin 29 of the bag 13. (These two rows of zippers may be referred to generally as first and second fastener elements). As shown in FIG. 3 and mentioned above, the carrier strip 51 carrying the first row of teeth 155 is generally annular (e.g., rectangular) in shape, and the peripheral edge margin 29 carrying the second row of teeth 157 is generally of the same shape. The bottom part 51C of the carrier strip 51 is sewn to the back portion 63 of the belt 61 to secure the bottom part of the carrier strip to the belt.

The zipper 151 also includes a slide fastener 160 (FIG. 8) which releasably interengages the first and second rows of teeth 155, 157 for fastening the bag 11 to the support structure 15. It is to be understood that fastener means other than a heavy duty zipper could be used to secure the bag 13 to the support structure 15, such as snap fasteners, buttons or the like. A heavy duty zipper was chosen in the preferred embodiment because of its relatively high burst strength (e.g., 110 pounds/inch). It is also understood that a number of shorter zippers, placed at intervals along the carrier strip 51 and peripheral edge margin 29, could be used instead of the one long zipper of the preferred embodiment.

The carrier strip 51 further includes a cover flap 163 (see FIG. 6) extending continuously along the carrier strip for protecting the zipper 151. The cover flap 163 is releasably engageable with the peripheral edge margin 29 of the bag 13. More particularly, a VELCRO fastening strips 165 is sewn to the underside of the cover flap 163 and a mating VELCRO fastening strip 167 is sewn to the peripheral edge margin 29 of the bag 13 (FIG. 6). These VELCRO fastening strips 165, 167 extend continuously along the length of their respective cover flap 163 and edge margin 29. By pressing the VELCRO fastening strip 165 on the cover flap 163 against the VELCRO fastening strip 167 on the peripheral edge margin 29 along the entire cover flap, the cover flap 163 is positioned to overlie and protect the zipper 151. The VELCRO strips 165, 167, when engaged, have a burst strength of approximately 7 pounds per inch. To access the zipper 151, the cover flap 163 is released by pulling it away from the peripheral edge margin 29 of the bag 13. Straps (not shown) may be provided for relieving pressure on the bag (and the zipper) as is well known in the art.

Figure 8:
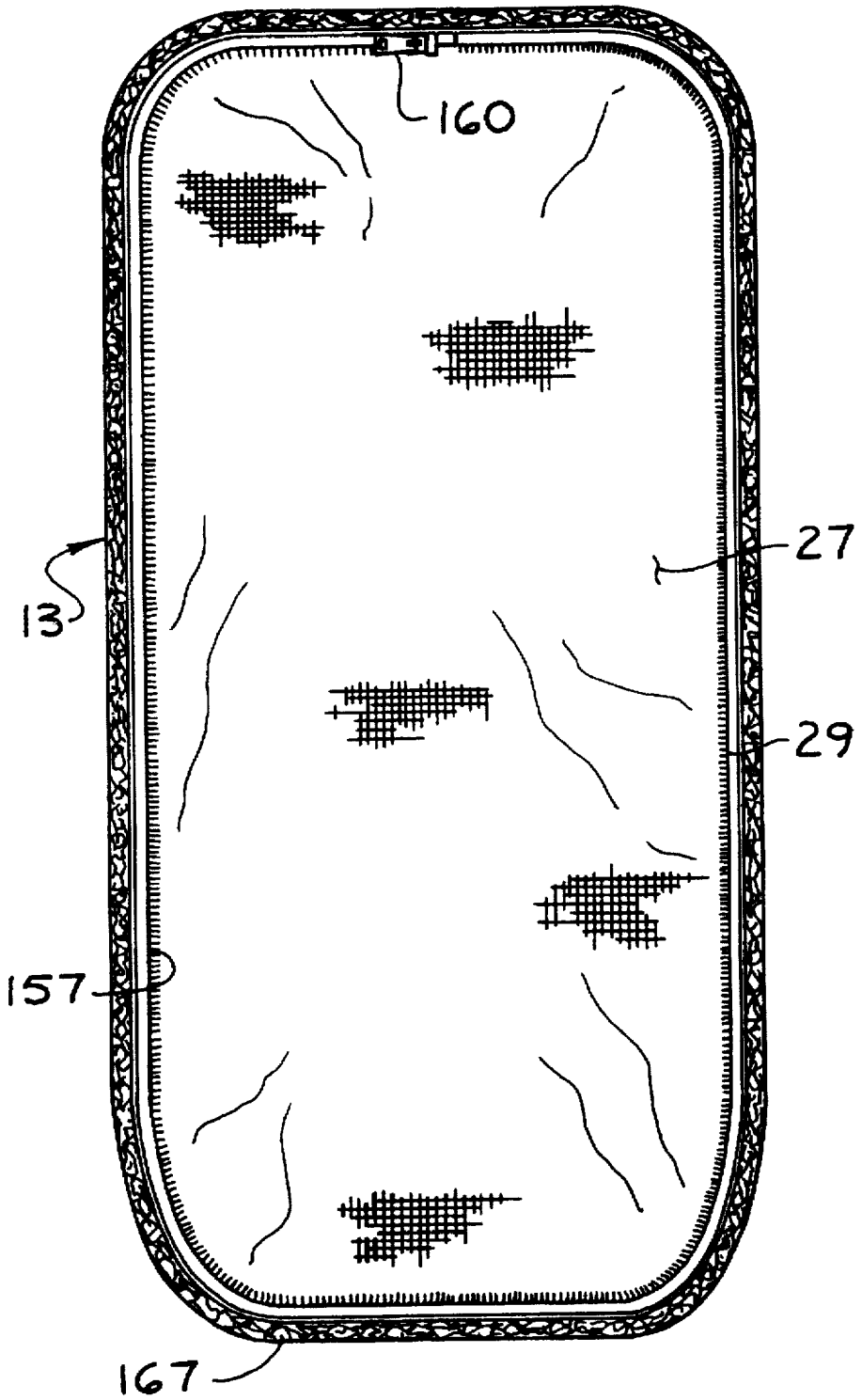
FIG. 8 is an elevational view of a bag of the backpack illustrated in FIGS. 1–6.

Thus, it will be observed that the bag 13 may be easily removed from the support structure 15 for cleaning or repair. FIGS. 4 and 8 illustrate a bag of conventional construction. The backpack 11 may also comprise a plurality of bags, each of which has a fastener element (such as a row of teeth) attached to its peripheral edge margin capable of mating with a fastener element (such as the row of teeth 155) on the carrier strip 51 of the support structure 15 so that the bags can be used interchangeably with the backpack 11. The bags may have differing sizes and shapes for varying uses. The following is a list of some of the bags which may be available for use with the backpack of the present invention: day and a half sport climbing bag (approximately 2000 cubic inches); mountaineering bag (approximately 3500 cubic inches); backpacker/angler bag (approximately 5500 cubic inches); expedition bag (approximately 6500 cubic inches); child carrier; photo bag; canoe bag; and hunter bag. The variety of bags enables the person wearing the backpack 11 to choose a bag suitable for a specific purpose. For example, a large capacity bag (backpacker/angler bag or expedition bag) may be chosen for an extended hike.

Figure 9:
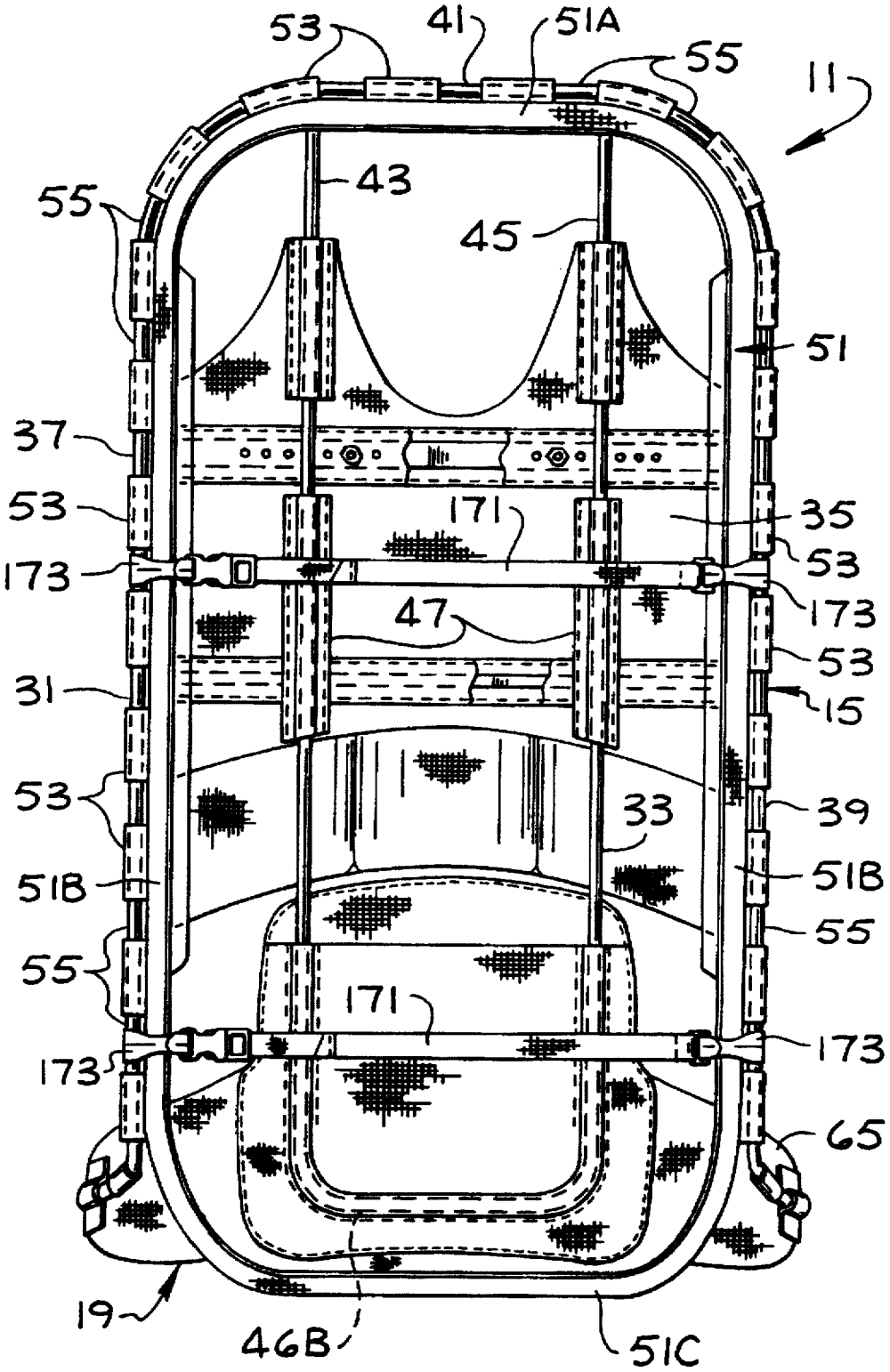
FIG. 9 is a rear elevational view of a "freighter" configuration which utilizes the support structure of the backpack shown in FIGS. 1–8.

The person wearing the backpack 11 may choose not to attach the bag 13 to the support structure 15, but may instead opt for holding items on the support structure by means of straps, such as the straps 171 shown in FIG. 9. This configuration is commonly referred to as a "freighter" pack. As shown, each strap 171 includes clips 173 at opposite ends of the strap engageable with the exposed portions 55 of the side frame members 37, 39 to releasably fasten the strap 171 to the outer frame 31. The straps 171 are constructed to be cinched for tightening the strap against a load held on the support structure 15. Bulky items, not suited to be stored in the bag 13, may be held on the support structure 15 by a plurality of these straps 171.

Figure 10:
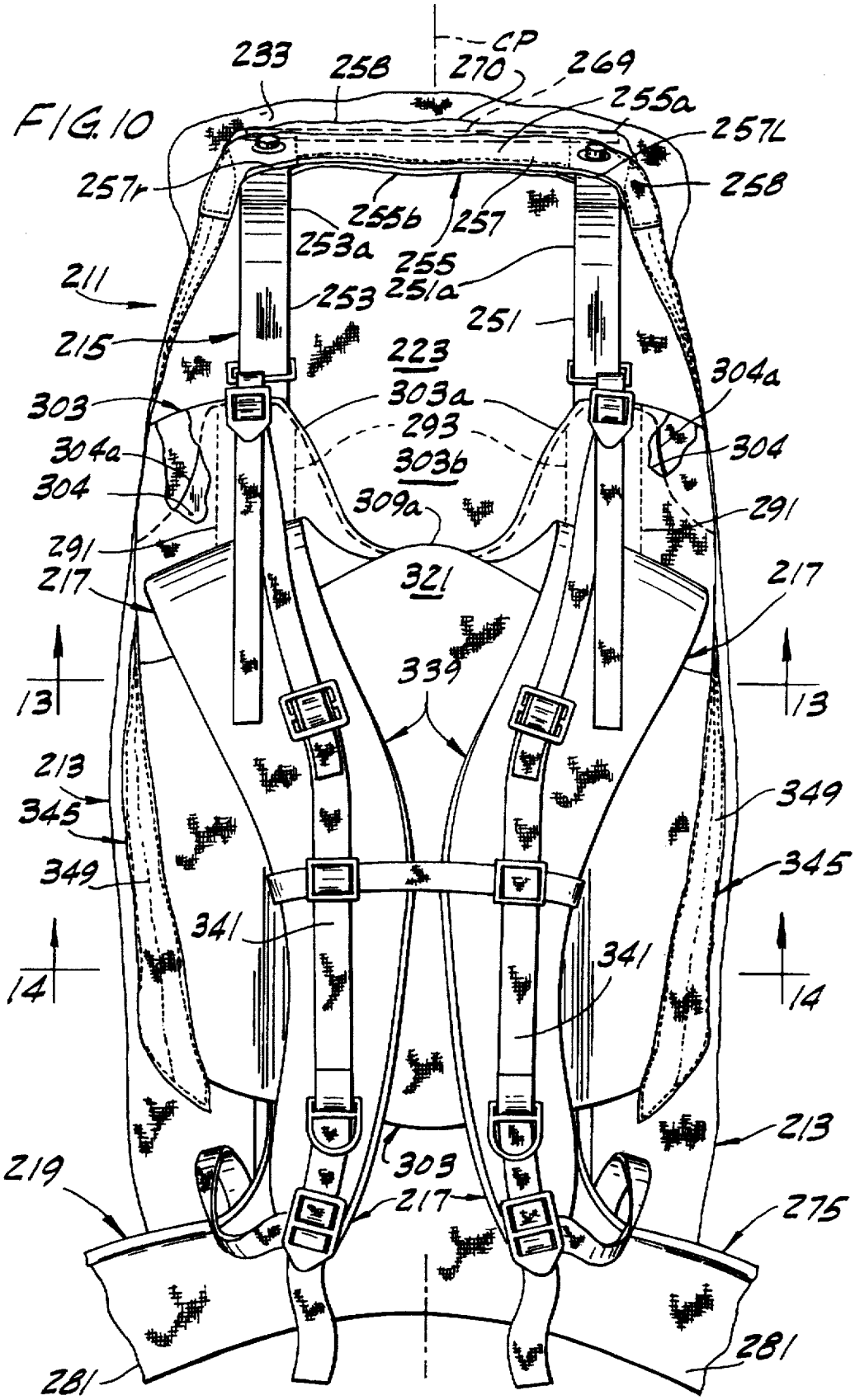
FIG. 10 is a view in elevation of the front of a second embodiment (which is the preferred embodiment) of a backpack of this invention.

Referring to FIG. 10 et seq., a second backpack embodying, inter alia, the principal aspect of the invention is indicated in its entirety by the reference numeral 211. As in the first embodiment (FIGS. 1–9), the backpack 211 comprises a bag generally indicated at 213, a support structure generally indicated at 215 for supporting the bag, a shoulder harness, generally indicated at 217 for releasably securing the backpack around the user's shoulders, and a belt assembly generally indicated at 219 for releasably securing the backpack around the user's waist. Here again, the backpack 211 is constructed from relatively lightweight materials (e.g., nylon, plastic and aluminum) so that it is easy to carry.

Figure 11:
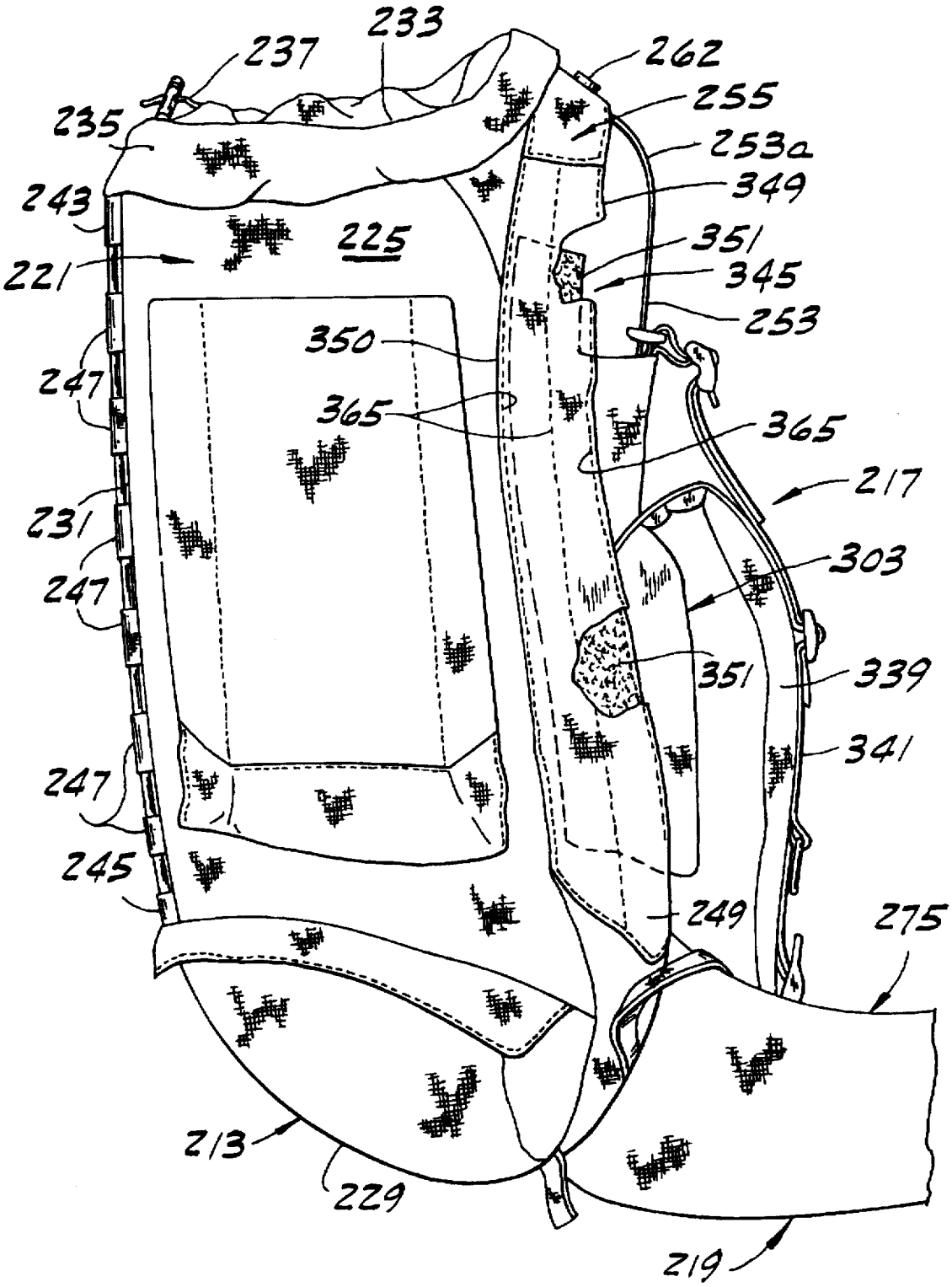
FIG. 11 is a side elevation of FIG. 10, certain strapping being omitted.
Figure 12:
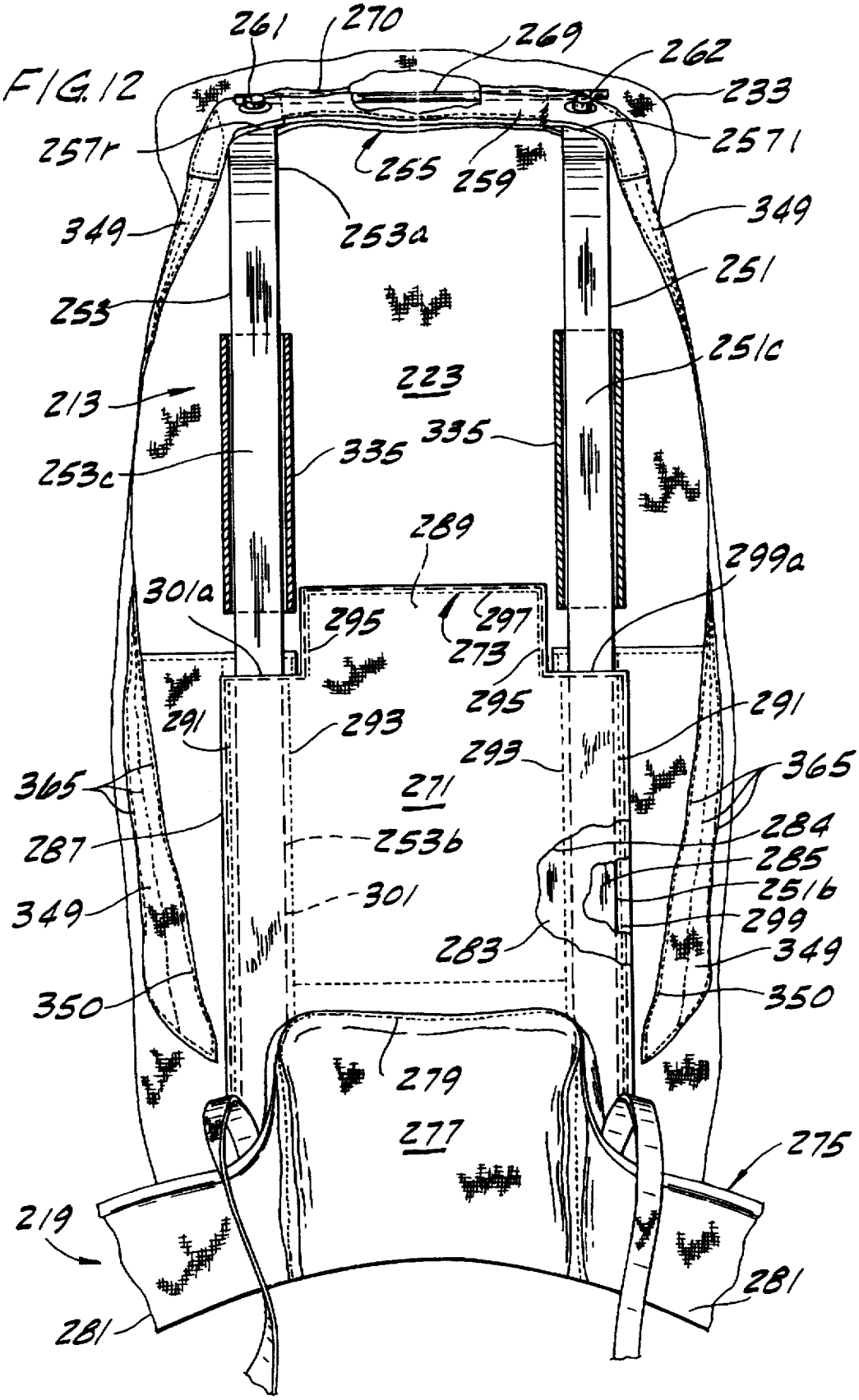
FIG. 12 is a view similar to FIG. 10 with parts broken away and shown in section.

The bag 213 is constructed of flexible sheet material (e.g. nylon) and is releasably attached to and supported by the support structure 215, which is discussed in greater detail below. In general, and as shown more particularly in FIGS. 11, 13 and 14, the bag has a main body, designated 221 in its entirety, having a wall 223 referred to as the front wall of the bag since it is positioned toward the front of the backpack, i.e. toward the back of the user as the backpack is worn, left and right side walls 225 and 227 ("left" and "right" being in relation to the position of the backpack as worn on the user's back), a bottom 229 and a back wall 231. FIGS. 10 and 12 being front views, i.e. views looking in the direction toward the front of the user, the user's "right" is at the left and the user's "left" is at the right as seen therein. As indicated at 233 in FIG. 11, the main body of the bag is open-mouthed at the top where it has a skirt 235 having a drawstring 237 for drawing the skirt closed to close the bag. The skirt may be of a fabric different from that of the bag, being suitably stitched as indicated at 238 in FIG. 15 to the main body of the bag. Pockets such as indicated at 239 may be provided on the side walls of the bag, slide closures (not shown) being provided in suitable manner for opening and closing these pockets. The bag may be compartmentalized, with slide fasteners for the compartments, in any desired suitable manner. The compartmentalization of the bag is not critical insofar as this invention is concerned; there may be wide variation in the compartmentalization. Relatively stiff rods such as indicated at 241 are provided extending generally vertically adjacent opposite sides of the back wall 231 of the main body 221 of the bag. These rods (which may be metal rods such as three-sixteenth inch diameter aluminum rods) are pocketed at their upper and lower ends in fabric pockets 243 and 245 on the back wall 231 and extend through fabric loops 247 on the back wall. Strapping such as indicated at 249 is provided extending between the rods, the strapping having means such as the buckles indicated at 250 for enabling pulling the strapping tight and holding it tight to compress a load in the bag. The rods 241 distribute the stress on compression of the load.

The support structure 215 for supporting the bag 213 comprises a frame comprising a pair of laterally spaced side frame members, viz. a left side frame number 251 (which appears at the right in FIGS. 10 and 12) and a right side frame number 253 (which appears at the left in FIGS. 10 and 12), these frame members being located adjacent opposite sides of the backpack extending on the outside of the front wall 223 of the bag from adjacent the top of the front wall 223 to the adjacent bottom of the bag. Each of these side frame members comprises a flat metal bar, e.g. an aluminum bar about one inch wide and one-eighth inch thick, each bent at one end thereof constituting its upper end to have an upper end portion inclined as shown best in FIG. 11 generally upwardly and rearwardly with respect to the backpack as worn. The bent upper end portion of bar 251 is designated 251*a* and the upper end portion of the bar 253 is designated 253*a*.

The main body 221 of the bag has a top flap 255 extending outwardly from its front wall 223 in forward direction with respect to the position of the backpack as worn on the user's back adjacent the top of the front wall. This flap, which is caught in stitching 238 securing the closure skirt 235 to the top of the main body of the bag, comprises two plies of fabric—an outer or upper ply 255*a* and an inner or lower ply 255*b*. These plies are stitched together at their outer edge as indicated at 257 with left and right-hand gaps 257*l* and 257*r* in the stitching adjacent the sides of the bag for insertion of the upper ends 251*a* and 253*a* of the side frame members 251 and 253. A stiffener such as a piece of relatively stiff but flexible plastic material such as indicated at 258 is stitched as indicated at 259 in position underlying the ply 255*a* at each gap. The upper ends 251*a* and 253*a* of the side frame members 251 and 253 extend through the gaps 257*l* and 257*r* in the stitching between the stiffener and the lower ply 255*b*, each of said upper ends being detachably secured within the flap 255 between the stiffener and the lower ply by means indicated generally at 260, shown in detail in FIG. 15 as comprising a pin 261 having a head 262, the head being located on the outside of the upper ply, the pin extending through a grommet 263 in a hole in the upper ply 255*a*, a hole 264 in the side frame member, and through a grommet 265 in a hole in the lower ply 255*b*, and being detachably maintained in place by a split ring 267 inserted in a hole 268 in the pin adjacent its free end (its lower end). The side frame members 251 and 253 extend down from the flap 255 overlying the front wall 223 of the bag 213 generally all the way to the bottom of the bag. At 269 is indicated means extending across the front wall 223 of the bag at the top thereof for stiffening the front wall at the top comprising a metal rod, such as a ¼ inch diameter aluminum rod or tribe pocketed in a loop 270 of fabric material extending across the top of the front wall 223 caught in the stitching 238. This rod 269 may be regarded as an upper frame member of the aforementioned support structure or frame 215.

The belt assembly 219 comprises a central panel 271 which is secured as by stitching such as generally indicated at 273 on the outside (the front) of the front wall 223 of the bag 213, and a belt generally designated 275 having a generally central padded portion 277 secured as by stitching such as indicated at 279 to the panel 271, padded side portions each designated 281 extending forwardly from the sides of the padded central portion 277 of the belt, and suitable strap and buckle means (not shown but which may be similar to the strap and buckle means described above for the embodiment of FIGS. 1–9) for releasably securing the padded side portions 281 together, with the central portion 277 and side portions 281 encircling the user's waist. The central panel 277 of the belt assembly is of multi-ply construction, comprising a ply 283 of relatively stiff material, e.g. of relatively stiff but flexible sheet plastic material, sandwiched between plies 284 and 285 of flexible fabric (e.g. nylon) material, having a lower portion 287 of generally rectangular shape having a width somewhat less than the width of the front wall 223 of the bag and a height about one-half the height of the front wall 223 and an upper portion 289 of reduced width extending up a relatively short distance from the lower portion. The stitching 273 securing the central panel 271 of the belt assembly 219 to the front wall 223 of the bag comprises lines of stitching 291 extending along the side edges of the lower part 287 of the panel 271, lines of stitching 293 spaced inward from and parallel to lines 291, lines of stitching 295 extending along the side edges of the reduced-width upper part 289 of the panel 271, and a line of stitching 297 extending across the upper edge of part 289. The parallel lines of stitching 291 and 293 at the left side of the panel 271 form a pocket indicated at 299 for the lower half of the length of the left-hand bar 251 and the parallel lines of stitching 291 and 293 at the right side of the panel 271 form a pocket indicated at 301 for approximately the lower half of the length of the right-hand bar 253. These pockets are open-mouthed at their upper ends as indicated at 299*a* and 301*a*. The bars 251 and 253 are inserted in their respective pockets through the upper ends of the pockets and extend down the pockets to the lower end of the pockets at the bottom of the bag. The stiffened panel 271 may be regarded as a lower frame member of the aforementioned support structure or frame 215.

The lower half (approximately) of bar 251 pocketed in the pocket 299 is indicated at 251*b*; the lower half (approximately) of bar 253 pocketed in the pocket 301 is indicated at 253*b*. The upper portion of bar 251 extending up out of pocket 299 to the upper flap 255 is designated 251*c* and the upper portion of bar 253 extending up out of the pocket 301 to the upper flap is designated 253*c*, these upper portions 251*c* and 253*c* of the bars being on the outside of and free of the front wall 223 of the bag. Generally indicated at 303 is a slider slidably connected to the support structure or frame 215, more particularly to the free portions 251*c* and 253*c* of the side frame members or bars 251 and 253 of the frame, for sliding up and down on the frame (i.e. sliding up and down on portions 251*c* and 253*c* of the frame) within the limits imposed by the bent upper end portions 251*a* and 253*a* of the bars 251 and 253 and by the upper ends 299*a* and 301*a* of the pockets 299 and 301. The slider 303 is of multi-ply construction comprising a ply 304 of relatively stiff sheet material (e.g. relatively stiff but flexible sheet plastic material) sandwiched between plies 305 and 306 of fabric material, a back ply 307 of fabric material on ply 306 and a cell-forming front ply 309 of fabric material on the ply 305. Ply 307 faces toward the back of the user (toward the front wall 223 of the bag) as the backpack is worn and is referred to as the back ply of the slider. The stiff ply 304 has an upper edge indicated at 304*a* and a lower edge indicated at 304*b*. Ply 309 has an upper edge indicated at 309*a*.

Figure 13:
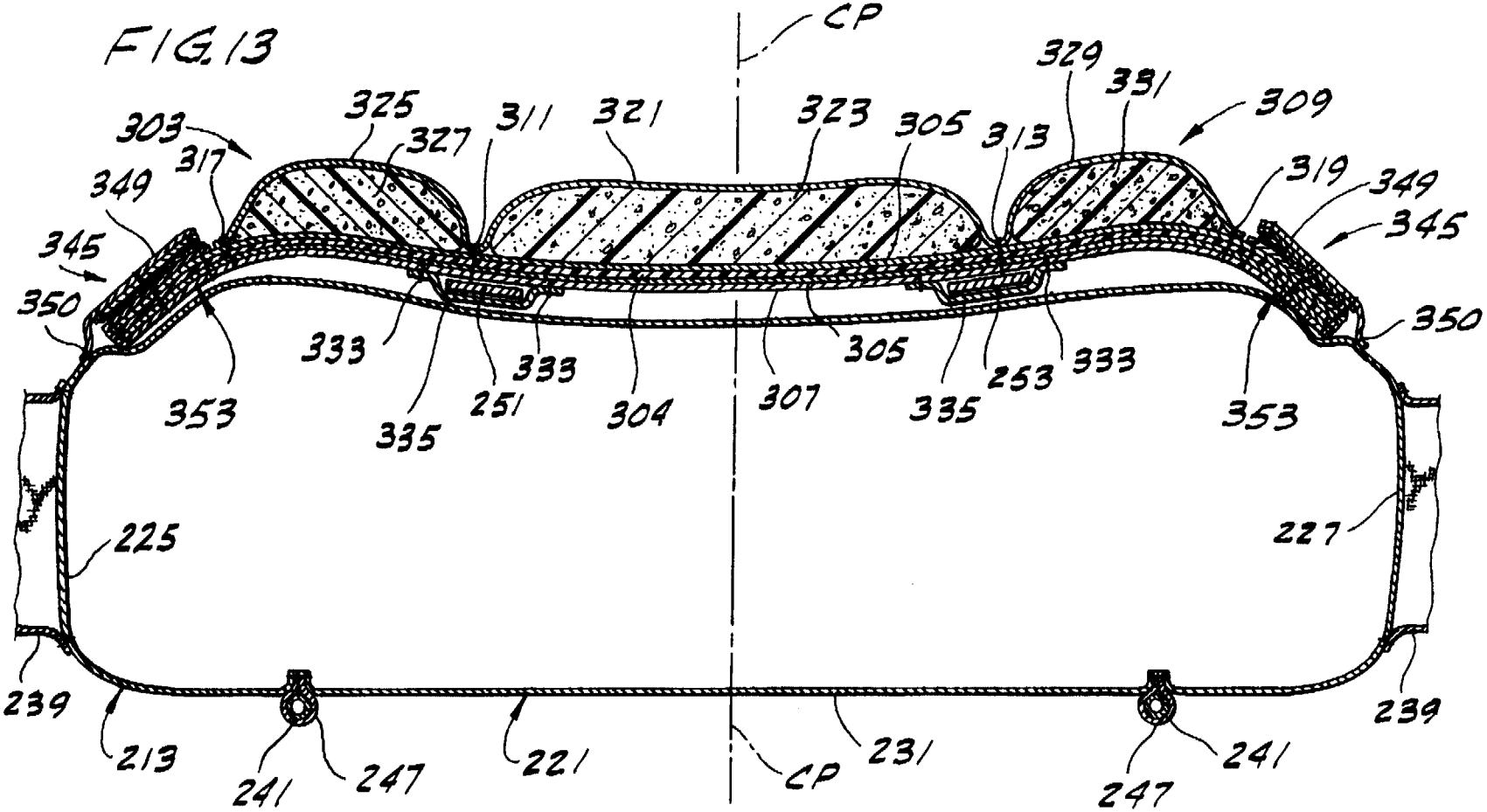
FIGS. 13 and 14 are views in horizontal section generally on lines 13—13 and 14—14 of FIG. 10, on a larger scale than FIG. 10.
Figure 14:
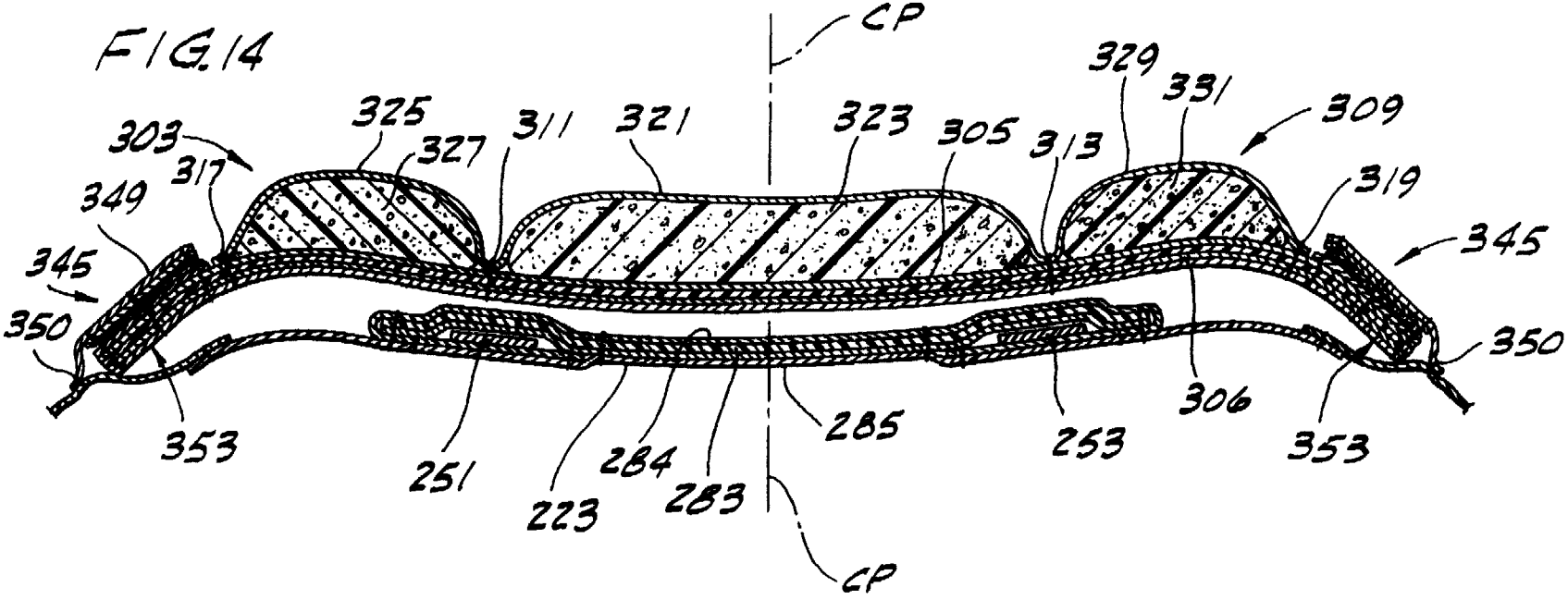
Figure 15:
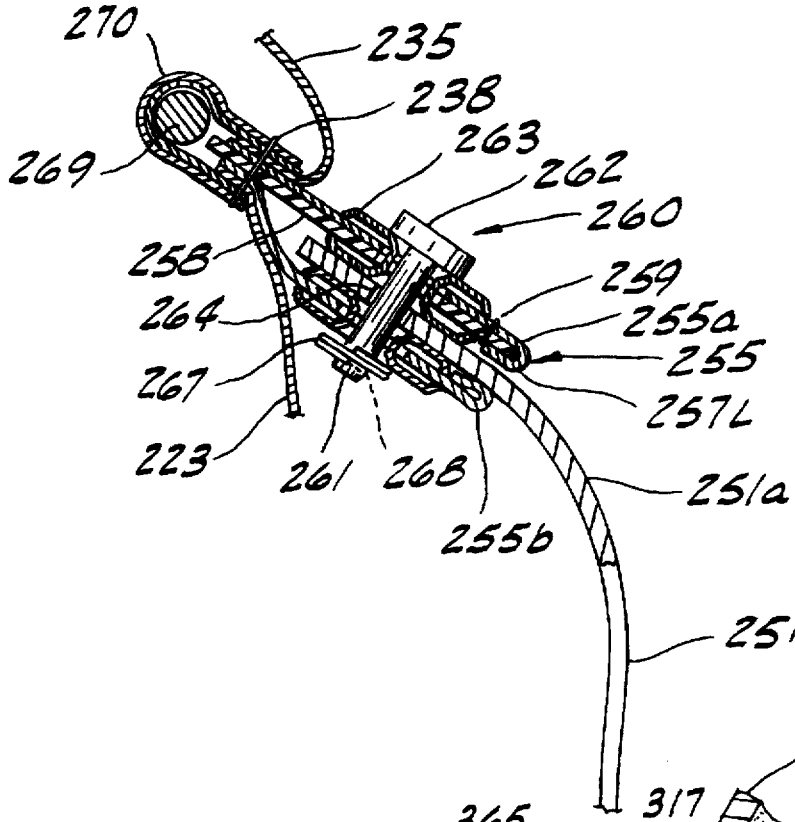
FIG. 15 is an enlarged section on line 15—15 of FIG. 10.
Figure 16:
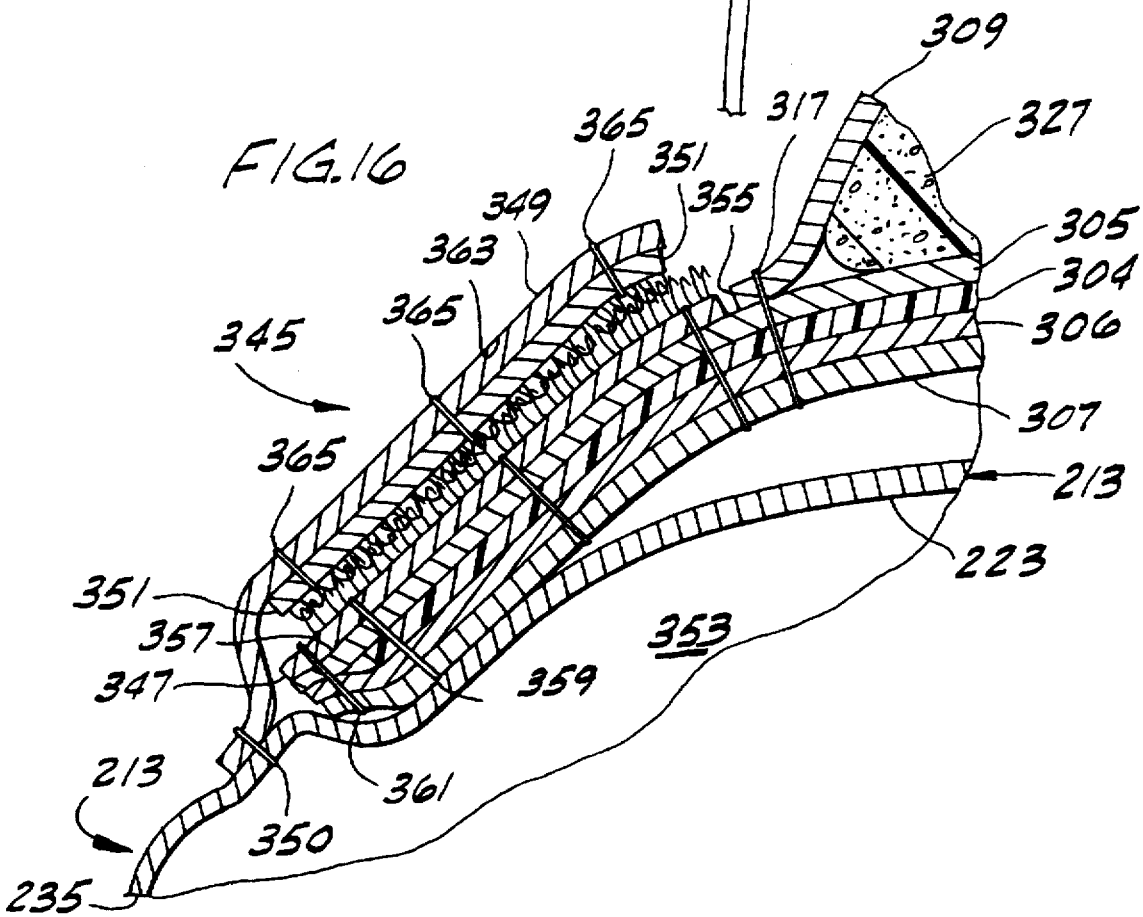
FIG. 16 is an enlarged fragment of FIG. 14.
Figure 17:
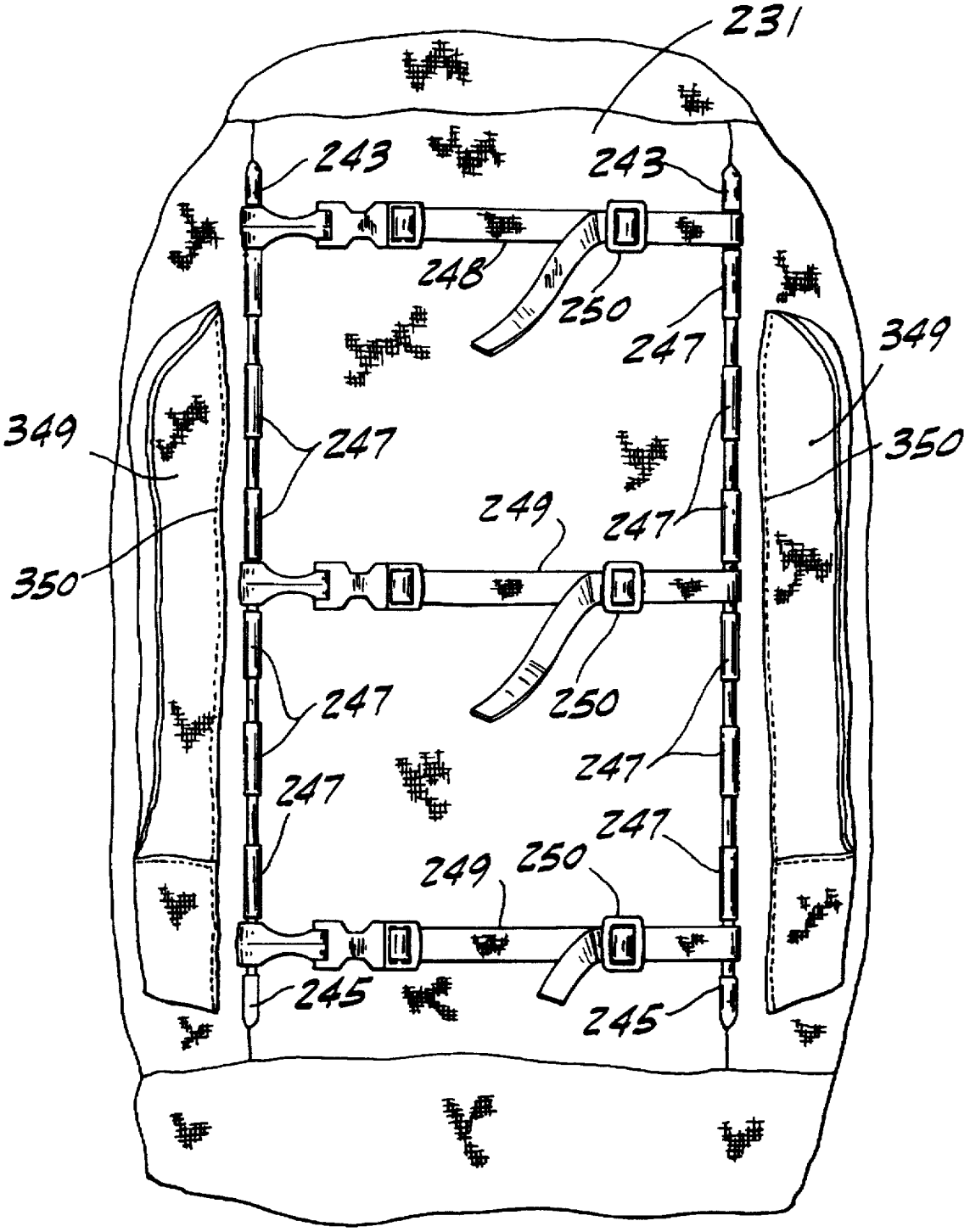
FIG. 17 is a view in elevation of the back of the bag of the second embodiment.
Figure 18:
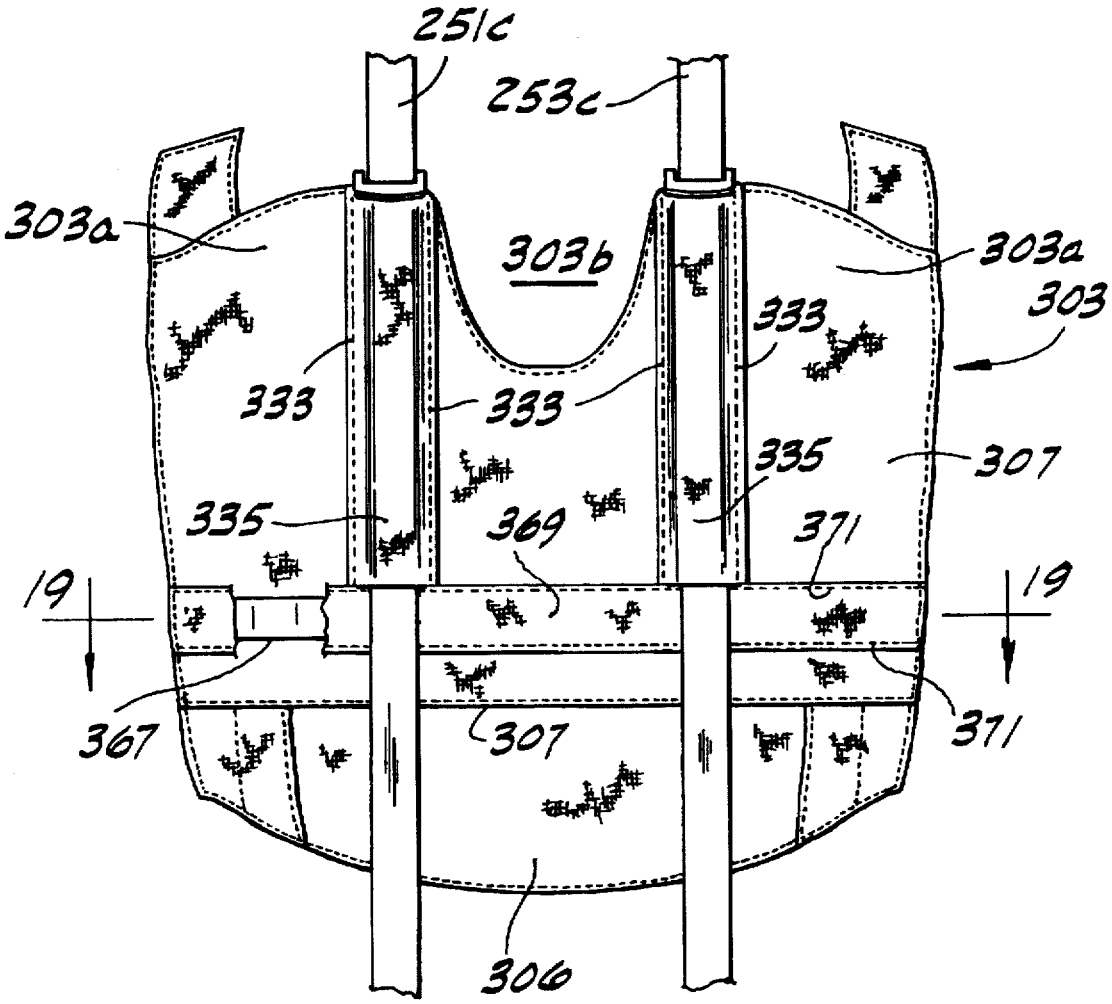
FIG. 18 is a view in elevation of the back of the slider of the second embodiment, showing bars on which the slider is slidable.

The plies 305 and 309 of the slider are stitched together on left and right heightwise lines of stitching indicated at 311 and 313 on opposite sides of the heightwise central plane CP of the slider (the heightwise plane midway of the bars 251 and 253, as shown in FIGS. 10, 13 and 14), and on left and right heightwise lines of stitching indicated at 317 and 319 laterally outwardly of lines 311 and 313. The fabric plies 305 and 306 and the stiffener ply 304 of the slider 303 extend up at opposite sides of the slider, so that the slider has left- and right-hand upper end extensions each designated 303*a* at opposite sides thereof at the top bounding a cut-out 303*b* at the top of the slider. Plies 305 and 309 and lines 311 and 313 define a central cell 321 of the slider containing padding 323. This central cell of the slider, which may be referred to as the central padded panel of the slider, spans the distance between the bars 251 and 253. Plies 305 and 309 and lines 311 and 317 define a left-hand cell 325 of the slider containing padding 327. Cell 325 may be referred to as the left-hand padded panel of the slider. Plies 305 and 309 and lines 313 and 319 define a right-hand cell 329 of the slider containing padding 331. Cell 329 may be referred to as the right-hand padded panel of the slider. Stitched as indicated at 333 on the back of the slider are left- and right-hand elongate loops of fabric material each designated 335 which extend heightwise of the slider and encircle the free portions 251*c* and 253*c* of the bars 251 and 253 for connecting the slider to these bars and permitting up and down sliding movement of the slider relative to the bars within the limits previously specified.

The aforesaid shoulder harness, indicated generally at 217, is attached to the slider 303 for releasably securing the backpack 211 to the shoulders of a person wearing the backpack, the slider and the shoulder harness attached thereto being slidable up and down on the frame (i.e. on portions 251*c* and 253*c* of bars 251 and 253 of the frame to adjust the position of the shoulder harness to suit a person wearing the backpack. The loops 335 provide sliding connections between opposite sides of the slider and the respective side frame members or bars 251 and 253 of the support structure or frame 215 for permitting up-and-down movement of the slider relative to the frame while prohibiting substantial side-to-side movement of the slider relative to the frame. The shoulder harness 217 may be similar to the shoulder harness described above for the embodiment of FIGS. 1–9. Its details are not critical insofar as the embodiment of FIGS. 10–16 is concerned. It will suffice to say that the shoulder harness includes a pair of shoulder straps each here designated 339 (corresponding to the shoulder straps 121 of the embodiment shown in FIGS. 1–9), and flexible top leashes each designated 341 (corresponding to the leashes 133 and 135 of the embodiment shown in FIGS. 1–9).

The backpack 211 has means generally designated 345 for releasably fastening the slider 303 in adjusted position relative to the support structure or frame 215, i.e. in adjusted position heightwise of the frame, comprising a pair of VELCRO fastening members each designated 347 (see particularly FIG. 16) secured to the slider adjacent opposite sides thereof, these members 347 being referred to as the first VELCRO fastening members, and further comprising fabric members or flaps each designated 349 stitched as indicated at 350 to the bag 213 and thus secured to the support structure or frame 215 for the bag 213 (since the bag is secured to the frame), and generally fixed against up-and-down movement relative to the support structure or frame, and a pair of second VELCRO fastening members each designated 351 secured to the fabric members or flaps 349 in position for being releasably engaged in interlocking manner by said first VELCRO members 347 in various positions of the slider 303 up-and-down on the frame 249. The plies 305, 304, 306 and 307 of the slider extend laterally outwardly beyond the lines of stitching 317 and 319 to provide side flaps each designated 353 extending laterally outwardly at opposite sides of the slider, each of these flaps including side portions of the plies 305, 304, 306 and 307 but not including any portions of the cell formed by ply 309, which has side margins such as indicated at 355 in FIG. 16 receiving the stitching at 317 and 319. It will be understood that ply 309 is of such overall width in the flat as to allow for its bulging out between the lines of stitching 317, 311, 313 and 319 to form the padded cells.

Each of the said first VELCRO fastening members 347 comprises a strip of VELCRO material, such as VELCRO hook material, extending heightwise on the forward-facing face 357 of the respective flap 353 secured to the flap by stitching such as indicated at 359 which also stitches together the plies in the flap and by stitching 361 which stitches together the strip 347 and the plies 305, 306 and 307 outward of the edge of ply 304. Each of the said second VELCRO fastening members 351 comprises a strip of VELCRO material, such as VELCRO loop material, extending heightwise on the rearward-facing or inside face 363 of the flap 349 secured to the flap 349 by stitching such as indicated at 365.

Figure 19:
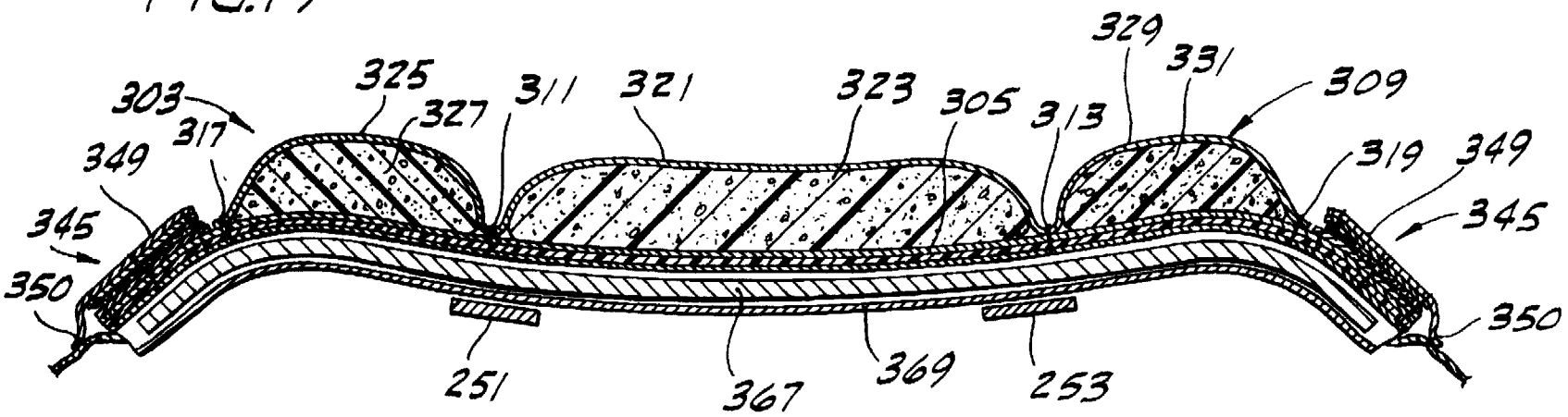
FIG. 19 is a view in horizontal section on line 19—19 of FIG. 18.

As shown in the slider 303 is provided with a reinforcing member or rib 367, more particularly a flat metal bar which may be made of the same stock as bars 251 and 253, extending transversely across the slider from one side to the other side thereof, and with means such as indicated at 369 holding the reinforcing member or rib in place extending transversely across the slider. As illustrated, this holding means 369 comprises a strip of fabric material extending transversely across the back of the slider from adjacent one side of the slider to adjacent its other side, stitched as indicated at 371 along both margins of the strip (its upper and lower margins) to the slider thereby forming a pocket in which the reinforcing member or bar is inserted from one end thereof, which is left open for insertion of the bar. The latter is curved as appears in FIGS. 13, 14 and 19 to cause the slider to assume a curved shape conforming to the shape of a user's back.

With the bag side flaps 349 carrying the said second VELCRO strips 351 pulled out away from the bag 213 to release the VELCRO strip 351 from the said first VELCRO strips 347 on the side flaps 353 of the slider, the slider may be slid up or down on portions 251*c* and 253*c* of the bars 251 and 253 thereby to adjust the vertical position of the shoulder harness 217 to suit the body shape of the user. With the slider vertically adjusted to the desired position, it is releasably fastened in said adjusted position heightwise relative to the supporting structure or frame 219 by interengaging the said second VELCRO strips 351 on the bag side flaps 349 with the said first VELCRO strips 347 on the slider side flaps 353 and pressing the VELCRO strips together.

It will be observed that the above-described first embodiment of the invention (FIGS. 1–9) comprises:

- a bag 13 having front and back walls;
- a support structure 15 for the bag comprising a frame 31 extending heightwise of the bag on the outside of the front wall of the bag adjacent opposite sides of the bag;
- a slider 35 slidably connected to the frame for sliding up-and-down on the frame in front of the front wall of the bag, said slider having opposite sides adjacent respective sides of the frame;
- a shoulder harness 17 attached to the slider for releasably securing the backpack to the shoulders of a person wearing the backpack, said slider and shoulder harness attached thereto being slidable up and down on the frame to adjust the position of the shoulder harness to suit a person wearing the backpack;
- sliding connections 53 between the slider and the frame for permitting up and down movement of the slider relative to the frame; and
- means for releasably fastening the slider in adjusted position heightwise relative to the frame;
- said fastening means comprising:
- first VELCRO fastening members 111 secured to the slider adjacent opposite sides thereof;
- fabric members 115A and 115B secured to the support structure and generally fixed against up and down movement relative to the structure; and
- second VELCRO fastening members 113 secured to said fabric members in position for being releasably engaged in interlocking manner by said first VELCRO fastening members in various adjusted positions of the slider heightwise with respect to the frame.

And it will be observed that the above-described second embodiment of the invention (FIGS. 10–19) also comprises:

a bag 213 having front and back walls;

a support structure 215 for the bag comprising a frame including left and right side frame members 251, 253 extending heightwise of the bag on the outside of the front wall of the bag adjacent opposite sides of the bag;

a slider 303 slidably connected to the frame for sliding up-and-down on the frame in front of the front wall of the bag, said slider having opposite sides adjacent respective sides of the frame;

a shoulder harness 217 attached to the slider for releasably securing the backpack to the shoulders of a person wearing the backpack, said slider and shoulder harness attached thereto being slidable up and down on the frame to adjust the position of the shoulder harness to suit a person wearing the backpack;

sliding connections 335 between the slider and the frame for permitting up and down movement of the slider relative to the frame; and means for releasably fastening the slider in adjusted position heightwise relative to the frame;

said fastening means comprising:

first VELCRO fastening members 347 secured to the slider adjacent opposite sides thereof;

fabric members 349 secured to the support structure and generally fixed against up and down movement relative to the structure; and second VELCRO fastening members 351 secured to said fabric members in position for being releasably engaged in interlocking manner by said first VELCRO fastening members in various adjusted positions of the slider heightwise with respect to the frame.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A backpack comprising:

a bag having front and back walls;

a support structure for the bag comprising a frame extending heightwise of the bag on the outside of the front wall of the bag adjacent opposite sides of the bag;

a slider slidably connected to the frame for sliding up-and-down on the frame in front of the front wall of the bag, said slider having opposite sides adjacent respective sides of the frame;

a shoulder harness attached to the slider for releasably securing the backpack to the shoulders of a person wearing the backpack, said slider and shoulder harness attached thereto being slidable up and down on the frame to adjust the position of the shoulder harness to suit a person wearing the backpack;

sliding connections between the slider and the frame for permitting up and down movement of the slider relative to the frame; and means for releasably fastening the slider in adjusted position heightwise relative to the frame;

said fastening means comprising:

first VELCRO fastening members secured to the slider adjacent opposite sides thereof;

fabric members secured to the support structure and generally fixed against up and down movement relative to the structure; and second VELCRO fastening members secured to said fabric members in position for being releasably engaged in interlocking manner by said first VELCRO fastening members in various adjusted positions of the slider heightwise with respect to the frame.

2. A backpack as set forth in claim 1 wherein the frame comprises a pair of laterally spaced side frame members and said sliding connections are adjacent opposite sides of the slider and respective side frame members.

3. A backpack as set forth in claim 2 wherein the front wall of the bag has an upper end and wherein each of the side frame members comprises a bar extending heightwise of the bag on the outside of the front wall of the bag from adjacent the bottom of the bag to adjacent the upper end of the front wall of the bag, each bar having an upper end secured to the bag at the upper end of the front wall of the bag.

4. A backpack as set forth in claim 3 wherein the bag has a flap at the top of the front wall of the bag extending outwardly from the front wall of the bag, and the backpack has means releasably securing the upper end of each of said bars and said flap.

5. A backpack as set forth in claim 4 wherein said flap comprises two plies of fabric material and wherein the upper end of each of said bars is curved rearwardly and extends in between said two plies of said flap.

6. A backpack as set forth in claim 5 wherein the means releasably securing the upper end of each of said bars to said flap secures said upper end of each of said bars in place between said two plies of said flap and is constituted by a pin connection including a pin extending through holes in said two plies of said flap and a hole in the upper end of the bar.

7. A backpack as set forth in claim 6 further having a stiffener extending transversely with respect to the bag at the top of the front wall of the bag generally between the upper ends of said bars.

8. A backpack as set forth in claim 7 wherein one of the plies of said flap is on the outside of the upper ends of the bars and other is on the inside, wherein said outside ply has a pair of stiffeners secured thereto on the inside thereof, one stiffener at the upper end of each of said bars, wherein each said pin has a head on the outside of said outside ply, each of the stiffeners on the inside of said outer ply has a hole for the pin, and each pin has means at its inner end inside the said inside ply for releasably securing it in place.

9. A backpack as set forth in claim 3 wherein each bar has a lower portion, and wherein said backpack has means at the front of the front wall of the bag for removably securing the lower portions of the bars to the bag, said bar securing means being spaced down from the upper end of the front wall of the bag, the bars having upper portions between said bar securing means and upper end of the front wall of the bag free of front wall of the bag, said sliding connections being slidable on said free portions of said bars.

10. A backpack as set forth in claim 9 wherein said sliding connections comprise fabric loops on the front of the slider slidable on said free portions of the bars.

11. A backpack as set forth in claim 10 wherein said bar securing means comprises a pair of pockets, one for each bar, at the front of the front wall of the bag, said pockets extending heightwise of the bag and having open upper ends spaced down from the upper end of the front wall of the bag, the bars extending down into the pockets.

12. A backpack as set forth in claim 11 wherein said slider comprises a ply of relatively stiff but flexible sheet material sandwiched between a front ply and a back ply of fabric material, and wherein said slider has a reinforcing member extending transversely thereacross from adjacent one side of the slider to the other side of the slider, and wherein said slider has means holding said reinforcing member in place extending transversely across the slider.

13. A backpack as set forth in claim 12 wherein said slider has a back facing the front wall of the bag and a padded front for cushioned engagement with the user's back, the means holding said reinforcing member in place comprising means forming an elongate pocket extending transversely across the back of the slide from adjacent one side of the slider to adjacent its other side, the reinforcing member comprising a bar inserted in the pocket.

14. A backpack as set forth in claim 13 wherein said reinforcing bar is curved to cause the slider to assume a shape conforming to the shape of a user's back.

15. A backpack as set forth in claim 14 wherein the plies of the slider have side portions which extend laterally outwardly beyond the padded front and being stitched together laterally outwardly of the padded front, said first VELCRO fastening members comprising elongate strips of VELCRO material extending heightwise on said side portions of the slider and being secured thereto by said stitching.

16. A backpack as set forth in claim 15 wherein said fabric members are constituted by flap of fabric stitched to the bag at opposite sides thereof, said bag side flaps each having an inside face and an outside face, said second VELCRO fastening members comprising elongate strips of VELCRO material stitched to the said bag side flaps on the inside faces thereof.

17. A backpack as set forth in claim 16 having a belt assembly comprising a central panel stitched to the front wall of the bag by stitching including a pair of spaced-apart parallel lines of stitching adjacent one side of the front wall of the bag and a pair of spaced-apart lines of stitching adjacent the other side of the front wall of the bag, each said pair of lines of stitching defining the pocket for the bar adjacent the respective side of the front wall of the bag.

18. A backpack as set forth in claim 17 wherein the bag has a first row of loops of fabric extending heightwise of its back wall adjacent one side and on the outside thereof, a second row of such loops extending heightwise of the back wall adjacent the other side and on the outside thereof, a relatively stiff rod extending heightwise of the bag through the loops of each row, and strapping extending between the rods having means whereby the strapping may be pulled and held tight to compress a load in the bag.

19. A backpack as set forth in claim 1 wherein said frame comprises laterally spaced inner side frame members and outer side frame members spaced laterally outwardly from said inner frame members, wherein said slider is slidably connected to said inner frame members and has opposite sides adjacent respective outer side frame members, the slider with the shoulder harness attached thereto being slidable up and down on said inner frame members to adjust the position of the shoulder harness to suit a person wearing the backpack, sliding connections between opposite sides of said slider and respective outer side frame members for permitting up and down movement of the slider relative to said outer side frame members while prohibiting substantial side-to-side movement of the slider relative to said outer side frame members.

* * * * *